US009463963B2

(12) United States Patent
Hey

(10) Patent No.: US 9,463,963 B2
(45) Date of Patent: Oct. 11, 2016

(54) DEEP WATER KNUCKLE BOOM CRANE

(71) Applicant: National Oilwell Varco, L.P., Houston, TX (US)

(72) Inventor: John Hey, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 40 days.

(21) Appl. No.: 13/728,040

(22) Filed: Dec. 27, 2012

(65) Prior Publication Data

US 2013/0168345 A1 Jul. 4, 2013

Related U.S. Application Data

(60) Provisional application No. 61/581,981, filed on Dec. 30, 2011.

(51) Int. Cl.

| | |
|---|---|
| ***B66C 23/53*** | (2006.01) |
| ***B66C 13/18*** | (2006.01) |
| ***B66C 23/88*** | (2006.01) |
| ***B66C 23/52*** | (2006.01) |
| ***B66C 23/00*** | (2006.01) |

(52) U.S. Cl.

CPC ..... *B66C 23/53* (2013.01); *B66C 13/18* (2013.01); *B66C 23/52* (2013.01); *B66C 23/54* (2013.01); *B66C 23/88* (2013.01)

(58) Field of Classification Search

CPC ..... B66C 23/52; B66C 53/53; B66C 23/70

USPC ..... 212/276, 279, 308, 309, 256, 260, 262, 212/347; 254/278, 281, 284, 285, 286, 275, 254/277

See application file for complete search history.

(56) References Cited

U.S. PATENT DOCUMENTS

| | | | |
|---|---|---|---|
| 13,976 | A | 12/1855 | Burnett |
| 1,582,274 | A | 4/1926 | Kaltenbach |
| 2,069,471 | A | 2/1937 | Baker |
| 2,414,573 | A | 1/1947 | Wagner et al. |

(Continued)

FOREIGN PATENT DOCUMENTS

| | | |
|---|---|---|
| CN | 2488894 | 5/2002 |
| CN | 101948002 | 1/2011 |

(Continued)

OTHER PUBLICATIONS

International Search Report and Written Opinion for related PCT Application No. PCT/US2012/071763 mailed Mar. 22, 2013 (8 pages).

(Continued)

*Primary Examiner* — Emmanuel M Marcelo
*Assistant Examiner* — Justing Stefanon
(74) *Attorney, Agent, or Firm* — Winthrop & Weinstine, P.A.

(57) ABSTRACT

A crane including an inner boom, an outer boom, a plurality of guide assemblies arranged along the length of the inner and outer boom and adapted for guiding a plurality of lines, and a multi-line material handling system including a first line having an outgoing portion extending to a sheave block, and an incoming portion returning from the sheave block to a supported anchor device, and a second line having an outgoing portion extending to the sheave block, and an incoming portion returning from the sheave block to the supported anchor device.

19 Claims, 24 Drawing Sheets

(56) References Cited

U.S. PATENT DOCUMENTS 2,512,477 A 6/1950 Bowes
2,966,752 A 1/1961 Wampach
2,995,900 A 8/1961 Hunsucker
3,101,816 A 8/1963 Fox
3,292,981 A 12/1966 Zaugg
3,421,581 A 1/1969 Geijn
3,591,022 A * 7/1971 Polyakov et al. ..... 414/138.3
RE27,261 E 12/1971 Bromel et al.
3,651,951 A 3/1972 Murakami
3,681,928 A 8/1972 Vincken et al.
3,918,379 A 11/1975 McNary et al.
3,943,868 A 3/1976 Person et al.
3,955,621 A 5/1976 Webb
3,967,867 A 7/1976 Richardson
3,977,531 A 8/1976 Brewer
4,039,177 A 8/1977 Person et al.
4,061,230 A 12/1977 Goss et al.
4,085,509 A 4/1978 Bell et al.
4,091,356 A 5/1978 Hutchins
4,104,608 A 8/1978 Melling et al.
4,135,841 A 1/1979 Watkins
4,155,538 A 5/1979 Claassen
4,180,171 A 12/1979 Cunningham et al.
4,184,600 A 1/1980 Goss et al.
4,200,054 A 4/1980 Elliston
4,210,897 A 7/1980 Hutchins
4,216,870 A 8/1980 Bonneson et al.
4,221,300 A * 9/1980 Rudak et al. ..... 212/309
4,223,961 A 9/1980 Martinez
4,271,578 A 6/1981 Robinson et al.
4,271,970 A 6/1981 Miller et al.
4,272,059 A 6/1981 Noerager et al.
4,354,606 A 10/1982 Morrow et al.
4,362,438 A 12/1982 Spink
4,367,981 A 1/1983 Shapiro
4,382,361 A 5/1983 Blanchet
4,395,160 A 7/1983 deJong
4,428,421 A 1/1984 Rankin
4,432,420 A 2/1984 Gregory et al.
4,446,977 A 5/1984 McClain
4,448,396 A 5/1984 Delago
4,506,591 A 3/1985 Blanchet
4,513,869 A 4/1985 Goudy
4,524,875 A 6/1985 Jamieson
4,557,332 A 12/1985 Denison et al.
4,606,469 A * 8/1986 Van Deijk ..... B66C 13/54
182/2.8
4,612,984 A 9/1986 Crawford
4,620,692 A 11/1986 Foreman et al.
4,633,951 A 1/1987 Hill et al.
4,648,729 A 3/1987 Jones
4,652,177 A 3/1987 Gunther, Jr. et al.
4,682,657 A 7/1987 Crawford
4,688,688 A 8/1987 Volakakis et al.
4,697,253 A 9/1987 Lind et al.
4,699,216 A 10/1987 Rankin
4,718,493 A 1/1988 Hill et al.
4,721,286 A 1/1988 Hey et al.
4,723,852 A 2/1988 Ehret
4,787,524 A 11/1988 Cobb, III et al.
4,808,035 A 2/1989 Stanton et al.
4,830,107 A 5/1989 Rumbaugh
4,858,694 A 8/1989 Johnson et al.
4,883,387 A 11/1989 Myers et al.
4,892,202 A 1/1990 Hey et al.
4,905,763 A 3/1990 Sauer et al.
4,913,238 A 4/1990 Danazcko et al.
4,913,592 A 4/1990 Petty et al.
4,923,012 A 5/1990 Hopmann
4,928,770 A 5/1990 Murray
4,928,771 A 5/1990 Vandevier
4,934,870 A 6/1990 Petty et al.
4,962,817 A 10/1990 Jones et al.
5,028,194 A 7/1991 Robinson
5,048,642 A 9/1991 Lloyd
5,190,107 A 3/1993 Langner et al.
5,209,302 A 5/1993 Robichaux et al.
H001232 H 9/1993 DiSiena
5,309,816 A 5/1994 Weyer
5,310,067 A 5/1994 Morrow
5,328,040 A 7/1994 Morrow
5,377,763 A 1/1995 Pearce et al.
5,487,478 A 1/1996 Morrow
5,509,513 A 4/1996 Kiesel
5,510,988 A 4/1996 Majeed et al.
5,542,783 A 8/1996 Pollack
5,551,803 A 9/1996 Pallini, Jr. et al.
5,558,467 A 9/1996 Horton
5,579,931 A * 12/1996 Zuehlke et al. ..... 212/276
5,660,235 A 8/1997 Sola
5,762,017 A 6/1998 Groves
5,803,613 A 9/1998 Riedel et al.
5,846,028 A 12/1998 Thory
5,894,895 A 4/1999 Welsh
5,901,864 A 5/1999 Morrow
5,951,227 A * 9/1999 Calkins et al. ..... 414/141.7
5,971,619 A 10/1999 Bourgeois-Jacquet
5,980,159 A 11/1999 Kazim
6,000,480 A 12/1999 Eik
6,082,947 A 7/2000 Adamson
6,173,781 B1 1/2001 Milne et al.
6,189,621 B1 2/2001 Vail, III
6,196,325 B1 3/2001 Connell et al.
6,216,789 B1 4/2001 Lorsignol et al.
6,241,425 B1 6/2001 Kazim
6,343,893 B1 2/2002 Gleditsch
6,354,380 B1 3/2002 Becnel et al.
6,367,390 B1 4/2002 Okubo et al.
6,367,553 B1 4/2002 Boyd
6,412,554 B1 7/2002 Allen et al.
6,422,408 B1 7/2002 Lissandre et al.
6,450,546 B1 9/2002 Montgomery et al.
6,467,593 B1 10/2002 Corradini et al.
6,478,086 B1 11/2002 Hansen
6,491,174 B1 12/2002 Day
6,502,524 B1 1/2003 Hooper
6,517,291 B1 2/2003 Pollack
6,530,430 B2 3/2003 Reynolds
6,530,691 B2 3/2003 Laenge
6,557,713 B1 5/2003 Laenge
6,592,297 B2 7/2003 Frijns et al.
6,691,784 B1 2/2004 Wanvik
6,712,560 B1 3/2004 Cottrell
6,739,395 B2 5/2004 Reynolds
6,789,981 B2 9/2004 Pollack
6,817,422 B2 11/2004 Jordan
6,836,707 B2 12/2004 Sowada et al.
6,837,311 B1 1/2005 Sele et al.
6,840,326 B2 1/2005 Shiyou
6,913,084 B2 7/2005 Boyd
6,915,849 B2 7/2005 Nuth
6,926,259 B1 8/2005 Roodenburg et al.
6,932,326 B1 8/2005 Krabbendam
6,968,900 B2 11/2005 Williams et al.
7,008,340 B2 3/2006 Williams et al.
7,051,814 B2 5/2006 Goode et al.
7,063,159 B2 6/2006 Patton et al.
7,073,602 B2 7/2006 Simpson et al.
7,328,811 B2 * 2/2008 Roodenburg et al. ..... 212/252
7,416,169 B2 * 8/2008 Noeske et al. ..... 254/275
7,487,954 B2 2/2009 Copp et al.
7,624,882 B2 * 12/2009 Commandeur et al. ..... 212/298
7,891,508 B2 2/2011 Delago
2002/0079278 A1 6/2002 Sanders et al.
2002/0166698 A1 11/2002 Beato
2002/0197115 A1 12/2002 Borseth
2003/0070600 A1 4/2003 Hooper
2003/0107029 A1 6/2003 Hanson et al.
2004/0026081 A1 2/2004 Horton, III
2004/0099421 A1 5/2004 Trewhella
2005/0077049 A1 4/2005 Moe et al.
2005/0087731 A1 4/2005 Scott
2005/0179021 A1 8/2005 Selcer et al.
2005/0211430 A1 9/2005 Patton et al.

(56) References Cited

U.S. PATENT DOCUMENTS

| | | | | |
|---|---|---|---|---|
| 2005/0242332 | A1 | 11/2005 | Ueki et al. | |
| 2006/0016605 | A1 | 1/2006 | Coles | |
| 2006/0078390 | A1 | 4/2006 | Olsen et al. | |
| 2009/0232625 | A1* | 9/2009 | Almeda, Jr. | B66C 23/52 414/139.6 |
| 2009/0261052 | A1* | 10/2009 | Vasstrand | 212/270 |
| 2011/0017695 | A1* | 1/2011 | Vandenbulcke et al. | 212/279 |
| 2011/0253661 | A1* | 10/2011 | Smith et al. | 212/255 |
| 2012/0034061 | A1 | 2/2012 | Boroy | |
| 2012/0217063 | A1 | 8/2012 | Roodenburg et al. | |
| 2012/0241404 | A1* | 9/2012 | Bobeck | B66C 23/68 212/300 |
| 2013/0129452 | A1* | 5/2013 | Vehmeijer et al. | 414/141.7 |
| 2014/0263142 | A1 | 9/2014 | Billiot et al. | |
| 2015/0259181 | A1 | 9/2015 | Billiot et al. | |

FOREIGN PATENT DOCUMENTS

| | | |
|---|---|---|
| DE | 495128 | 4/1930 |
| DE | 1200216 | 9/1965 |
| FR | 769741 | 8/1934 |
| GB | 2168944 | 7/1986 |
| KR | 101115367 | 2/2012 |
| SU | 1337338 | 10/1985 |
| WO | 2008022125 | 2/2008 |
| WO | 2009038468 | 3/2009 |
| WO | 2010093251 | 8/2010 |

OTHER PUBLICATIONS

International Search Report and Written Opinion for related PCT Application No. PCT/US2013/074978 mailed Feb. 28, 2014 (6 pages).

"Cranes with Active Heave Compensation", National Oilwell Varco, copyright 2008 (6 pages).

"Deepwater Lowering Concepts: Existing Systems & Food for Thought", National Oilwell Varco, ExxonMobil Presentation, Feb. 23, 2011 (25 pages).

"Deepwater Lowering Concepts: Existing Systems & Food for Thought", National Oilwell Varco, ExxonMobil Presentation, Feb. 23, 2011 (23 pages).

"AmClyde™ DB-50 DWLS/AHC Deepwater Lowering System w/Active Heave Compensation Model 80-S/N CW-4084", Proposal No. 8377-4, prepared for J. Ray McDermott, Feb. 24, 2010 (35 pages).

"Deepwater Lowering Concepts w/Active Heave Compensation", AmClyde Equipment Schemes Presentation, Jun. 23, 2007 (24 pages).

"Hydralift™ 250 MT Crane w/AHC 'Normand Clipper'", Mar. 24, 2006 (5 pages).

"JMC Technology Website Printout", <URL: http://www.jmc.no/technology/coiled_tubing/heave_compensators.php>, accessed on the Internet May 31, 2005 (2 pages).

* cited by examiner

DEEP WATER KNUCKLE BOOM CRANE

FIELD OF THE INVENTION

The present application relates to cranes and more particularly to knuckle boom cranes. Still more particularly, the present application relates to knuckle boom cranes for use in deep water applications such as offshore oil platforms or other offshore platforms, ships, barges, or other situations where the crane may be adapted to pick and lift a load or lower a load to a point that is significantly below the base of the crane.

BACKGROUND

Knuckle boom cranes have long since been used and are advantageous in offshore industries, in part, because of their relatively compact foot print and their ability to provide a relatively low boom tip height. For example, a knuckle boom crane may have a foot print of approximately half of the diameter of a comparable capacity lattice boom crane and the articulating inner and outer boom allows for lowering the boom tip to reduce the pendulum length between the boom tip and the picking hook. The smaller footprint offers advantages where the available area for equipment, material, workers, and working area is relatively small such as on a ship or oil platform. The lower boom tip and shorter pendulum length helps to reduce the swaying motion of a suspended load that may be induced by waves in the ocean, sea, or other waterway. The reduced swaying of the material can provide for more efficient handling of the material and can make for a safer working environment. However, the versatility of knuckle boom cranes can cause them to sacrifice lifting capacity.

Demands for higher capacity cranes continue to increase and demands for cranes that can access deeper waters also continue to increase. Where 100 to 250 metric ton cranes were previously sufficient, industry has demanded more capacity and 400 metric ton cranes have become commonplace. Where depths of 500 meters were previously sufficient, industry has demanded access to deeper waters and 1000 meter depths have become common place. Demands continue to increase and the industry is now requesting 600 metric ton, 700 metric ton and even 800 metric ton cranes. Moreover, not only does the industry want the higher lift capacity, the industry also wants to be able to access ocean depths of 3500 meters; more than 2 miles below the surface.

Solutions to achieve current capacities and payout lengths have involved increasing the cable diameter and length of cable. Each of these changes causes the cable spools (hoists) and associated wire ropes to increase in diameter and weight. The increase in cable/rope diameter and weight has led to relocating the spool (hoist) from the base of the crane to a location below the deck of ships, for example. However, the current demands have exhausted the capacity of this solution. That is, the cable spools (wire ropes) have reached a size and a weight that suppliers of currently available cabling (wire ropes) simply do not have the space in their facilities to produce such large spools of cable (wire ropes). For example, a spool for a cable for a 800 metric ton knuckle boom crane that can reach depths of 3500 meters would have wire rope with a diameter of 165 mm and a weight of approximately 460 metric tons. This solution has run its course and the industry is in need of alternative solutions.

SUMMARY

In one embodiment, a crane may include a rotatable base. The crane may also include an inner boom extending from a base end to a first knuckle end. The base end may be pivotally connected at a base pivot point to the rotatable base such that the inner boom is pivotable in a vertical plane about the base pivot point. The crane may also include an outer boom extending from a second knuckle end to a boom tip. The second knuckle end may be pivotally connected at a knuckle pivot point to the first knuckle end of the inner boom such that the outer boom is pivotable in the vertical plane about the knuckle pivot point. The crane may also include a plurality of guide assemblies arranged along the length of the inner and outer boom and adapted for guiding a plurality of lines. Each of the guide assemblies may include a rack structure and a plurality of line guides arranged on the rack structure. The crane may also include a multi-line material handling system. The multi-line material handling system may include a first line having a first end secured to a first winch drum. The first line may include an outgoing portion extending from the first winch drum and along one of the line guides of each of the plurality of guide assemblies to a sheave block, and an incoming portion returning from the sheave block to a supported anchor device. The multi-line material handling system may also include a second line having a first end secured to a second winch drum. The second line may include an outgoing portion extending from the second winch drum and along one of the line guides of each of the plurality of guide assemblies to the sheave block, and an incoming portion returning from the sheave block to the supported anchor device.

In another embodiment, a crane may include a knuckle boom crane having a base and a means for handling a load and lowering the load to a depth of 3500 meters below the base of the knuckle boom crane. The means for handling a load may have a capacity of 800 metric tons and, as such, may be capable of lowering a 500 metric ton load to the 3500 meter depth, for example.

While multiple embodiments are disclosed, still other embodiments of the present disclosure will become apparent to those skilled in the art from the following detailed description, which shows and describes illustrative embodiments of the package. As will be realized, the various embodiments of the present disclosure are capable of modifications in various aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures.

DETAILED DESCRIPTION

The present application, in some embodiments, relates to a high capacity deep water knuckle boom crane. In contrast to existing single line knuckle boom cranes, the knuckle boom crane may include a multi-line system. The multi-line system is provided with a series of guides in the form of sheave systems for guiding the lines along the doubly articulable boom system and accommodating the multitude of positions and arrangements the boom system is capable of forming, including an inversion of the outer boom relative to the inner boom. The multi-line system in place on the versatile boom allows for a reduction in the diameter of the line required to achieve a high lifting capacity. As such, suitable line spool sizes may be provided with lengths of line capable of reaching ocean depths exceeding 3500 meters while also providing crane capacities exceeding current industry standards.

Figure 1:
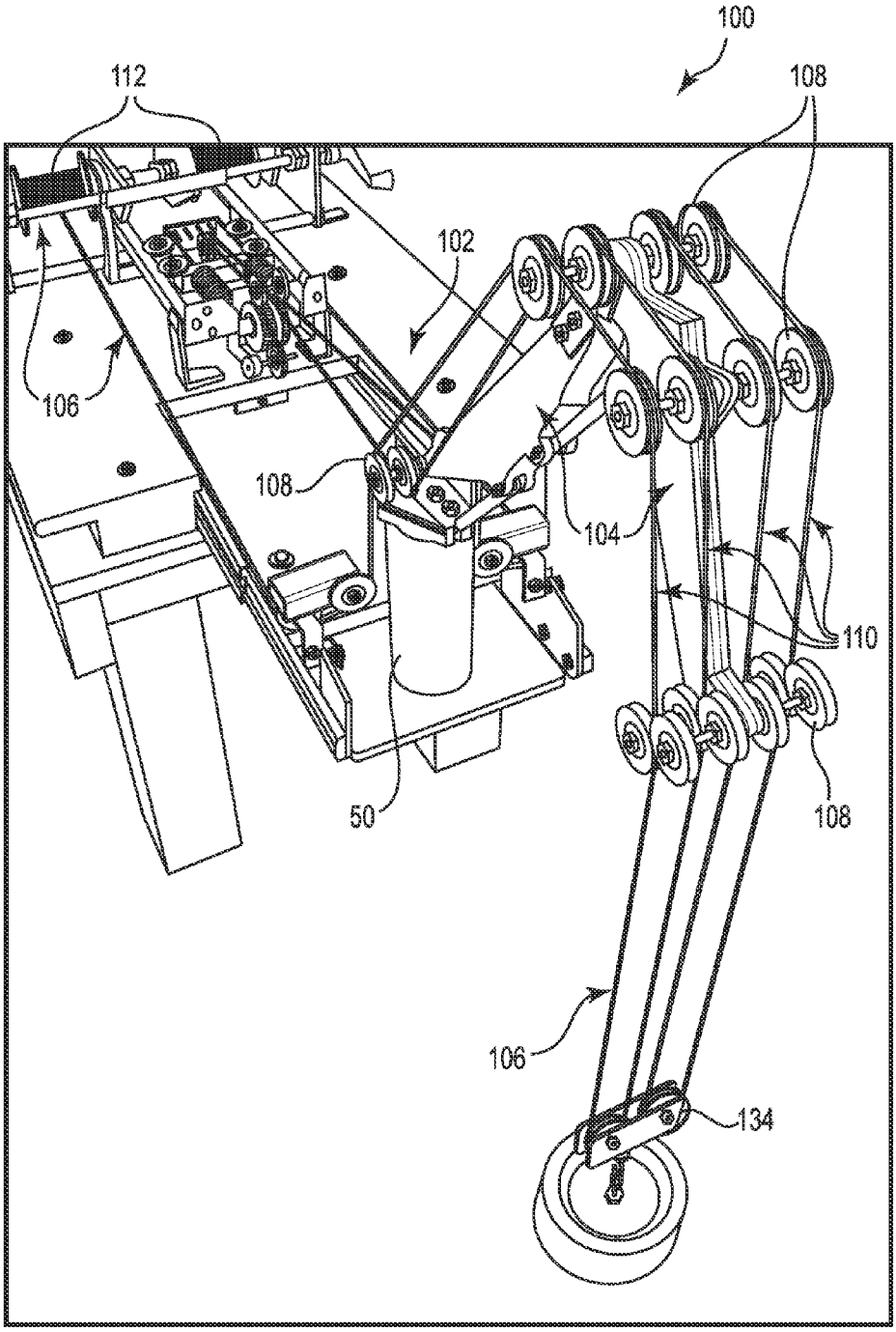
FIG. 1 is a perspective view of a model of a knuckle boom crane, according to some embodiments.

Referring now to FIG. 1, a knuckle boom crane 100 is shown. The crane 100 may include a base 102, a boom system 104, a material handling system 106 including one or more lines 110, and a guide system 108 for guiding the lines 110 of the material handling system 106. The base 102 may be rotatable relative to a supporting structure 50 and the boom system 104 may extend therefrom such that the boom system 104 rotates with the base 102. The boom system 104 may include a plurality of booms that may be articulated relative to the base 102 for picking, lifting, lowering, swinging, or otherwise handling material. The material handling system 106 may include one or more lines 110 and one or more winches 112 for in hauling or paying out the line 110. The guide system 108 may guide the lines 110 of the material handling system 106 as they are paid out or in hauled and may maintain the line 110 position relative to the boom system 104 and relative to other lines 110.

Base

Figure 2:
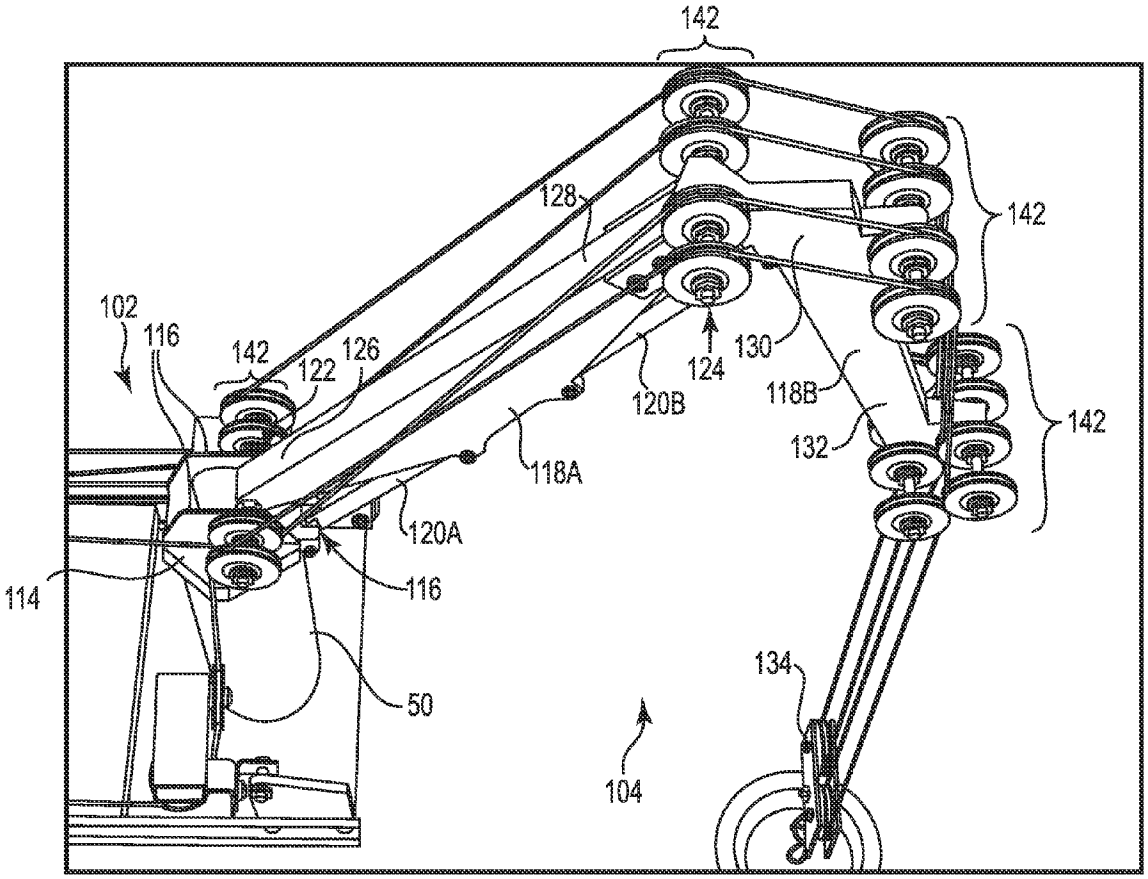
FIG. 2 is a close-up view of a boom system of the model crane of FIG. 1.

Referring to FIG. 2, the base 102 of the crane 100 may include a platform 114 and may be supported by a support structure 50. The support structure 50 may interface with the base 102 to provide vertical support and resist overturning of the base 102 relative to the support structure 50 while also allowing rotation of the base 102 about the support structure 50. The interface between the base 102 and the support structure 50 may include one or more vertically oriented roller bearings and may also include one or more radially oriented roller bearings. Several combinations of roller bearings or other interfaces may be provided. In some embodiments, a radial support bearing or pair of opposing and vertically offset radial support bearings may be used. In one embodiment, the radial support bearing described in U.S. Pat. No. 7,891,508 may be provided, the content of which are hereby incorporated by reference herein in its entirety. A traction drive mechanism may also be provided for engaging the support structure 50 and for controllably rotating the base 102 relative to the support structure 50.

In some embodiments, the base 102 may be supported by a support structure 50 in the form of a cylindrical pedestal and the base 102 may rotate atop the pedestal. The pedestal may be positioned on or form an on-land structure or the pedestal may be arranged on or form an offshore structure. In some embodiments, the pedestal may be arranged on a ship, barge, offshore platform, or other marine device or structure. Other structures other than cylindrical pedestals may also be provided such as other cross-sectional pedestals, or platforms, decks, or other supporting structures. In some embodiments, the base 102 may be capable of rotating 360 degrees around the support structure 50 or pedestal. The base 50 may also include a cab for an operator, a working platform or other similar structures or elements.

The base 102 may also include boom interfacing devices 116, such as brackets, hubs, ears, or other structures for interfacing with the boom system 104 described below. The boom interfacing devices 116 may include a boom bracket and a ram bracket, for example. The boom brackets may function to secure the boom or booms 118 of the boom system 104 to the base 102 and allow for free pivoting motion of the boom system 104 about the base 102. The ram brackets may function to secure rams 120 to the base 102 for controlling the pivoting articulation of the boom system 104.

In some embodiments, the boom brackets may include a pair of tab plates extending from the platform 114 of the base 102. The pair of tab plates may extend parallel to one another and may be spaced from one another a distance equal to the width of a boom 118, for example. The tab plates may each include a hole aligned with the hole in the other tab plate. A boom 118 may be arranged between the tab plates and may include a bore and a pivot pin may be arranged through the holes of the tab plates and the bore of the boom 118 to pivotally secure the boom 118 to the base 102. The center point of the hole in the tab plates and the centerline of the bore may define a base pivot point 122 for pivotally articulating the boom system 104 about the base 102. A bearing or bearings may be provided to allow the boom system 104 to pivot about the pivot point 122 of the base. In other embodiments, rather than providing tab plates on the base 102 for receiving a boom 118, a relatively broad lug may be provided on the base 102. In this embodiment, ear plates or tab plates may be provided on the boom 118 for arrangement on either side of the lug. The ear plates or tab plates may include a hole for alignment with a bore in the lug to receive a pivot pin. Other types of jaw-like connections may be provide to allow for pivoting motion between the boom 118 and the base 102.

The ram brackets may be the same or similar to the boom brackets. That is, tab plates may be provided on the base 102 for receiving an end of a ram 120 or tab plates may be provided on an end of a ram 120 for placement around a lug on the base 102. Depending on the size and design selections of the crane 100, namely, whether the boom system 104 is operated with a single series of rams 120 or whether the boom system 104 is operated with a series of paired rams 120, the base 102 may include a corresponding number of ram brackets.

Boom System

The boom system 104 may include one or more booms 118 pivotally extending from the base 102. In the case of the knuckle boom crane 100 shown, a pair of booms 118 extend in series from the base 102. An inner boom 118A may be pivotally connected to the base 102 via the boom bracket and an outer boom 118B may be pivotally connected to the inner boom 118A with a same or similar pivot connection. The connection between the inner and outer boom 118A, 118B may include a pivot pin defining a knuckle pivot point 124. The knuckle boom system 104 may thus articulate relative to the base 102 similar to a human finger with a single knuckle, for example.

The inner boom 118A may extend from a base end 126 coupled to the base 102 to a knuckle end 128. The inner boom 118A may be generally elongate and may be designed to withstand compressive and bending loads induced therein during operation by the weight of materials and/or equipment lifted, moved, or otherwise handled. The outer boom 118B may extend from a knuckle end 130 that is coupled to the knuckle end 128 of the inner boom 118A to a boom tip 132. The knuckle ends 128, 130 of the inner and outer boom 118A, 118B may be pivotally connected at the knuckle pivot point 124. In some embodiments, this may be in alignment with a rack structure to be described below. In other embodiments, the knuckle pivot point 124 may be isolated from any rack structure or other line guide system.

Each of the inner and outer booms 118A, 118B may include built-up, hot-rolled, cold-rolled steel structures or other steel structures. Other materials such as composite materials or other materials may also be used. In some embodiments, the booms 118A, 118B may include box beams formed from plate steel welded to form a generally rectangular cross-section, for example. Internal stiffeners, braces, backing bars, and other design and/or fabrication and/or erection related features may be provided. In some embodiments, the cross-section of the booms 118A, 118B may vary to provide a tapered boom as shown in FIG. 2. In this embodiment, the tapered shape of the inner boom 118A may allow for the rams 120 to be offset from the boom 118A and may also reflect the compressive and bending load diagram of the boom allowing for efficient use of material in constructing the boom. As shown, the inner boom 118A may be relatively thin near the base 102, may get relatively thick toward the mid-length of the boom 118A, and may get thinner again near the knuckle end 128 of the inner boom 118A. The outer boom 118B may be relatively thick near the knuckle end 130 and may get relatively thinner toward the boom tip 132.

The inner and outer booms 118A, 118B may be articulable via a plurality of rams 120. A single line of rams 120 that are generally centered along the length of the booms 118 may be provided, for example. In other embodiments, a pair of lines of rams 120 may be provided where a line of rams 120 extends along or adjacent the sides of the boom members 118. In some embodiments, the more heavily loaded portions of the boom 104 are operable via multiple rams 120 and more lightly loaded portions of the boom 104 may be operable via a single ram 120. The rams 120 may be hydraulic rams 120 or other types of rams 120 may be provided. The rams 120 may be controlled by an operator via a control device. Where the rams 120 are hydraulic, the rams 120 may be in fluid communication with a hydraulic fluid reservoir via hydraulic lines connecting the ram 120 to a pump and one or more valves, for example.

As shown, an inner ram 120A or plurality of inner rams 120A may be secured to the base 102 and secured to a ram bracket on the inner boom 120A. The ram bracket for the inner ram 120A may be spaced along the length of the inner boom 118A from approximately ¼ to ¾ of the length of the boom 118A or from approximately 5/16 to ½ of the length of the boom 118A or approximately ⅓ of the length of the boom 118A. Other locations for the inner ram bracket may also be provided and selected based on the anticipated crane loadings and other design optimizations. The inner ram 120A may thus be extended or contracted to control the angular position of the inner boom 118A. That is, as the inner ram 120A is extended, the inner boom 118A may pivot upwardly about the base pivot point 122 and as the inner ram 120A is contracted, the inner boom 118A may pivot downwardly about the base pivot point 122.

An outer ram 120B or plurality of outer rams 120B may be secured to the inner boom 118A via an outer ram bracket on the inner boom 118A and may also be secured to the outer boom 118B via another ram bracket. The outer ram bracket on the inner boom 118A may be spaced along the length of the inner boom 118A from approximately ¼ to ¾ of the length of the boom 118A or from approximately ½ to 11/16 of the length of the boom 118A or approximately ⅔ of the length of the boom 118A. Other locations for the outer ram bracket may also be provided and selected based on the anticipated crane loadings and other design optimizations. The outer ram 120B may thus be extended or contracted to control the angular position of the outer boom 118B relative to the inner boom 118A. That is, as the outer ram 120B is extended, the outer boom 118B may pivot so as to increase the distance between the boom tip 132 and the base 102 or travel outwardly away from the base 102, for example. As the outer ram 120B is contracted, the outer boom 118B may pivot so as to decrease the distance between the boom tip 132 and the base 120 or travel inwardly toward the base 102, for example.

Material Handling System

The crane 100 may be equipped with a material handling system 106 relying on the framework of the base 102 and the boom system 104 while providing in-hauling and payout capabilities. The material handling system 106 may include one or more winches 112 for paying out and hauling in line. In some embodiments, a single line 110 and a single winch 112 may be provided. In other embodiments, a plurality of winches 112 and corresponding lines 110 may be provided. The line arrangement for each winch 112 may generally include a portion wrapped on a winch drum, a portion extending along the boom 118 of the crane 100, and a portion extending from the boom tip 132 to a hook block 134. In some embodiments, a portion of the line 110 may return from the hook block 134 to an anchor point, for example. The winch may be operated in each of two directions to payout or inhaul line 110 such that material picked and lifted by the crane 100 may be raised or lowered by in hauling or paying out line 110 respectively.

Figure 3:
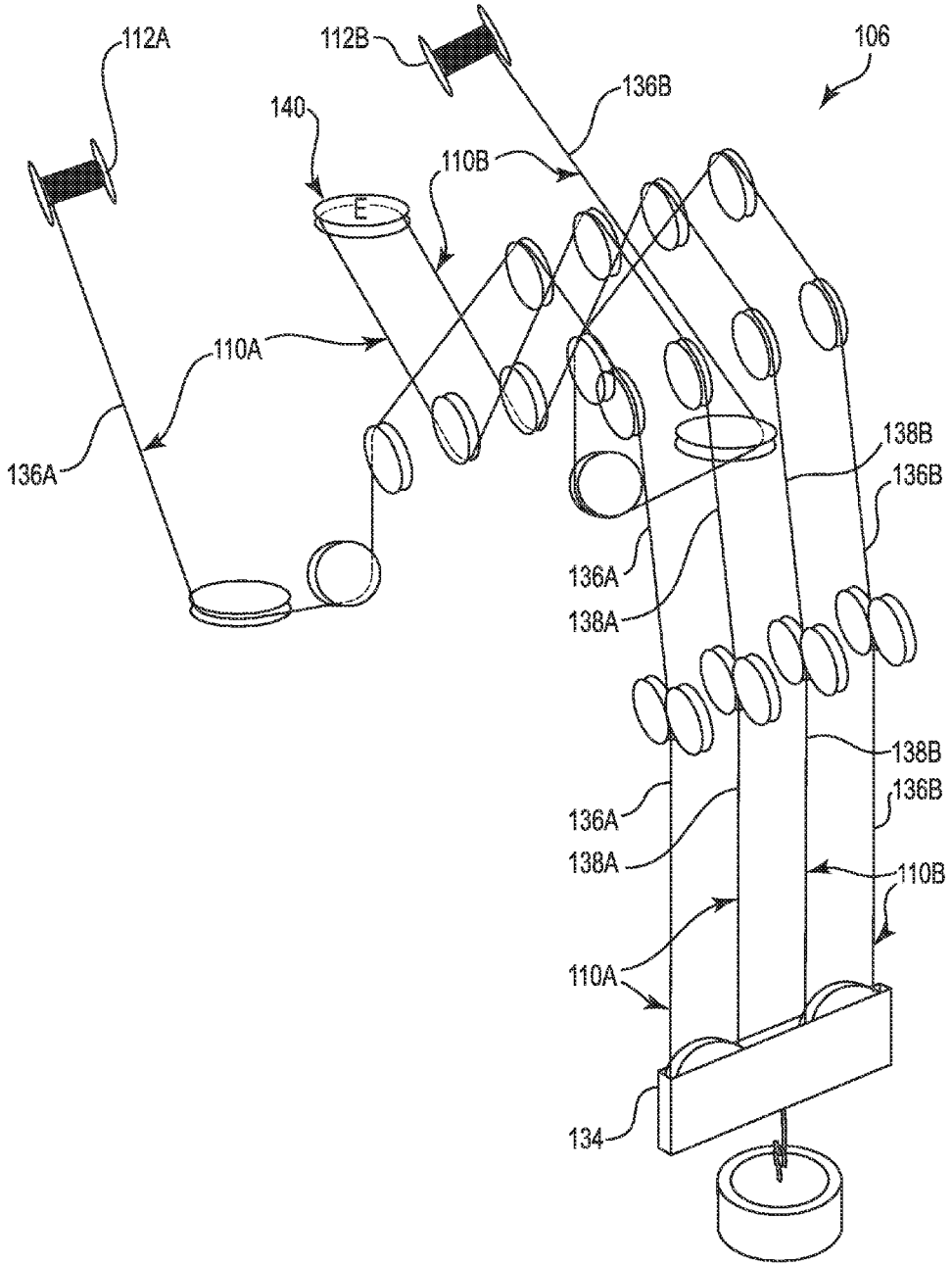
FIG. 3 is a schematic diagram of the material handling system of the model crane of FIG. 1.
Figure 4:
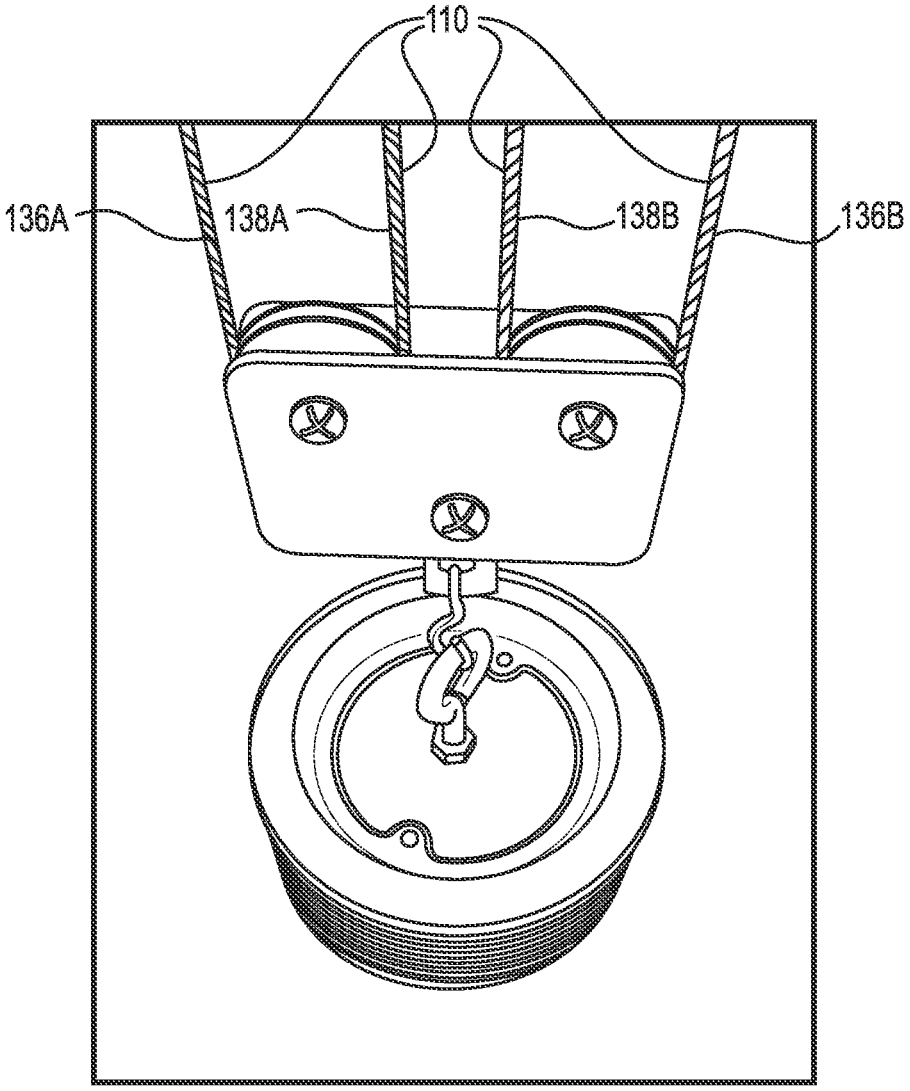
FIG. 4 is a close-up view of a load suspended from a hook block of the model crane of FIG. 1.
Figure 7:
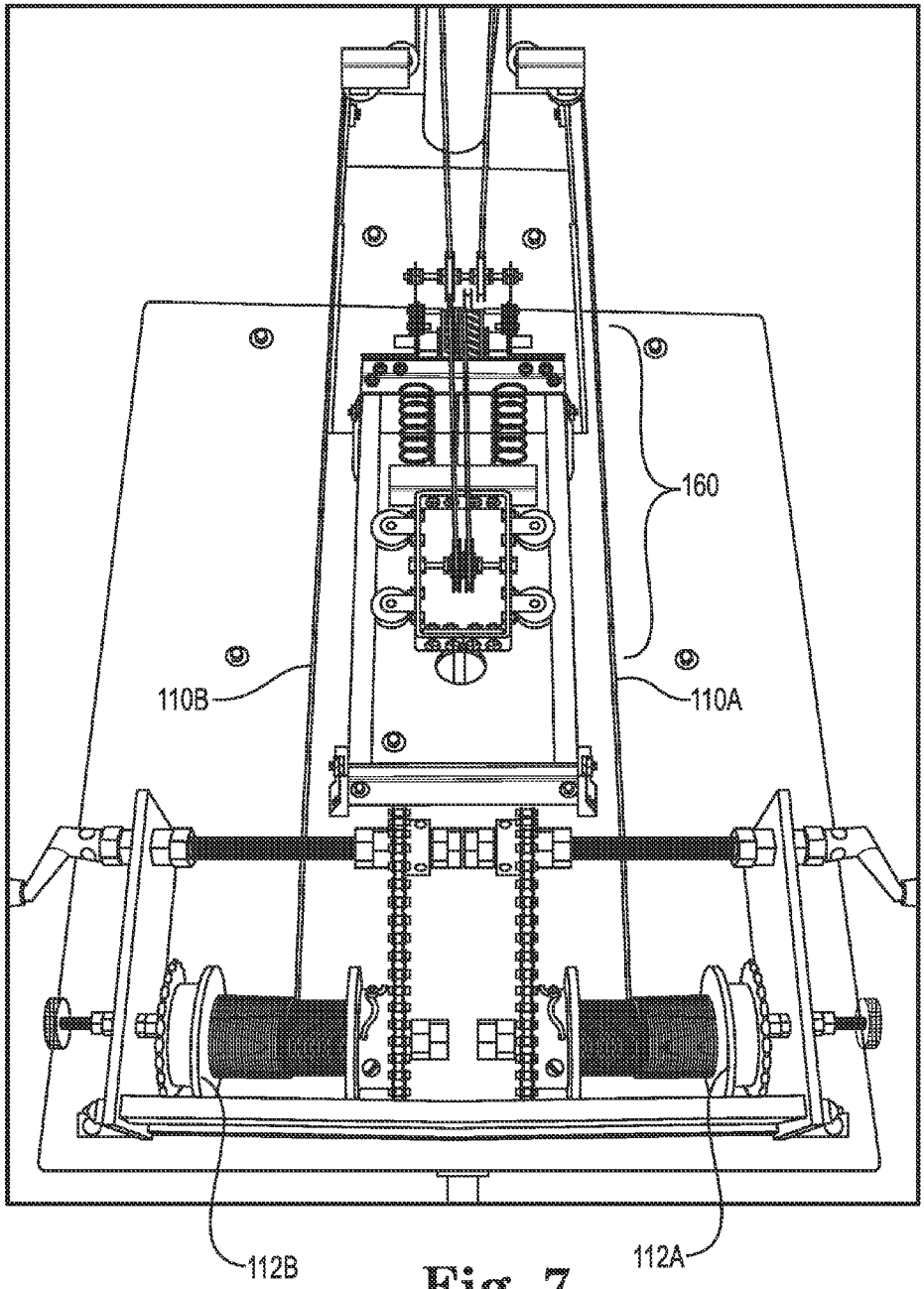
FIG. 7 is a top view of a portion of the material handling system of the model crane of FIG. 1.

As shown in FIGS. 1, 3, and 7, in one embodiment, a pair of winches 112 may be provided and each line 110 associated with the respective winches 112 may include an outgoing portion 136 and an incoming portion 138. As shown, an outgoing portion 136 of the line 110 may extend from the winch 112 to the boom 118 and may be supported along the length of the boom 118. The outgoing portion 136 may extend beyond the length of the boom 118 and may hang freely from the boom tip 132. The outgoing portion 136 may continue to a hook block 134, as shown in FIG. 4, where material, equipment, or other loadings may be supported. The incoming portion 138 of the line 110 may return from the hook block 134 and may be secured to an anchor point on the crane 100. In some embodiments, the incoming portion 138 may be secured to an anchor device 140 near the boom tip 132. In other embodiments, as shown, the incoming portion 138 may extend along and be supported by the boom 118 and may be secured to an anchor device 140 thereafter.

In some embodiments, the lines 110 associated with each winch 112 may be wire ropes. In some embodiments, the wire ropes may be opposite lay wire ropes. For example, in one embodiment a first line 110A may be a right lay line and a second line 110B may be left lay line. In still other embodiments, alternative rope materials may also be used.

Each of the lines 110 associated with the respective winches 112 may follow a substantially parallel path along the boom system 104, to the hook block 134, and back to the anchor device 140. As discussed in more detail below, the use of right lay and left lay wire ropes of similar construction may reduce the tendency of the lower block, or hook block, to twist or rotate at extended water depths. In the region between the boom tip 132 and the hook block 134, four line portions may work together to support a lifted load.

As shown, a first line 110A may extend from a first winch 112A and may include an outgoing portion 136A may extend along an outside edge of the boom 118 and extend downward from the boom tip 132. The corresponding incoming portion 138A may return from the hook block 134 and may be positioned nearer to the centerline of the boom 118. The outgoing and incoming portion 136A, 138A of the line 110A may be part of the same right lay line, for example, and may have a tendency to rotate the hook block 134 in a first direction. Without more, the incoming and outgoing portion 136A, 138A may cause the hook block 134 to twist causing the incoming and outgoing portion 136A, 138A of the line 110 to entangle. This can create a situation where load cannot be paid out or in hauled and can be particularly problematic when large lengths of line 110A are suspended from the boom tip 132. However, as also shown, a second line 110B extending from a second winch 112B may include an outgoing portion 136B that may extend along an opposite outside edge of the boom 118 and extend downward from the boom tip 132. The corresponding incoming portion 138B may return from the hook block 134 and may be positioned nearer to the centerline of the boom 118 than the corresponding outgoing portion 136B and generally adjacent to the first line's incoming portion 138A. The outgoing and incoming portion 136B, 138B of the line 110B may be part of the same left lay line, for example, and may have a tendency to rotate the hook block 134 in a second direction opposite the first direction. As such, rotation of the hook block 134 may be equally and oppositely biased such that no rotation occurs and entanglement of the lines 110A and 110B is avoided. In single line systems, particularly when the line is doubled back to an anchor point, more elaborate special rotation resistant lines are often used to avoid rotation of the load and entanglement of outgoing and incoming lines. The presently described system allows for the use of more commonly available and less expensive right lay and left lay ropes. It is noted that, while the outgoing portion 136 of the lines 110 are described as being along the outboard edge of the boom 118 and the incoming portions 138 of the lines are described as being inboard relative to the outgoing portions 136, an opposite arrangement may also be provided.

The presence of four line portions supporting the hook block 134 may allow for the tension in the line 110 due to the supported load to be reduced by a factor of four. That is, by way of comparison, and setting buoyant forces aside, a 100 metric ton load may cause 100 metric tons of tensile force in a single line. In contrast, in the presently described system, a 100 metric ton force may cause only 25 metric tons of tensile force in each of the four lines. Additional advantages relating to line design may be realized from this arrangement as described below.

A comparison of line arrangements was performed for a 400 metric ton load with a length of line capable of paying out 2000 meters. In a single line approach, a 103 mm diameter rope may be used having a single line pull capacity of 190.9 metric tons. The length of the line may be 2020 meters causing the total rope weight to be approximately 89 metric tons. In a double line approach, a 70 mm diameter rope may be used having a single line pull capacity of 93.7 metric tons. The length of the line may be 4040 meters (i.e., outgoing and incoming portions) causing the total rope weight to be approximately 82 metric tons. In a four line approach as described above, a 48 mm diameter rope may be used having a single line pull capacity of 46.4 metric tons. The length of line may be 8080 meters (i.e., 2-outgoing, 2-incoming) causing the total rope weight to be approximately 77.2 metric tons. (A savings of approximately 12 metric tons of rope compared to the single line approach) As such, not only can the rope diameter be reduced, and thus reduce the weight of each spool of line, the total rope weight may also be reduced making the system more efficient. This is, in part, because the live load calculations for material handling involve the application of a live load factor to the weight of the line portion between the winch and the hook block. By using the above-described four line approach, approximately ½ of the weight of the line may be omitted from the live load on the crane allowing for further optimization of the line diameter.

The described arrangement of lines 110 for a material handling system 106 provides advantages that may change the landscape of the paradigm of single line knuckle boom cranes. While the use of more than a single line entering and exiting a hook block may be known, these systems often involve one or two winches having outgoing lines that extend up a crane boom, down to a hook block and back up to a supported boom block. The lines may continue through the boom block and return to the hook block and extend back up to the boom block. In some cases, up to 32 lines or more including back and forth lines between the boom block and hook block may be provided. However, in these cases, the lines that extend along the boom of the crane generally include only the outgoing lines directly extending from the winch. Moreover, these lines are routed along a single boom articulable about a single pivot point and guiding the one or two lines along the boom may be relatively straightforward. In the present knuckle boom crane, multiple lines (including both outgoing and incoming lines) may extend the full length of the boom system and the boom system may include a doubly articulable boom and further may involve an ability for the outer boom to invert below the inner boom. Moreover, as will be discussed in more detail below, accommodations may be provided for handling the four lines near the base of the knuckle boom crane and below the base of the crane while allowing the crane to rotate through a range of motion.

Guide System

As the line 110 of the material handling system 106 extends from a winch 112, along the boom system 104, and to the hook block 134, the lines 110 may be guided along the boom system 104 by a plurality of guide assemblies 142. The guide assemblies 142 may be configured to transfer load from the lines 110 to the boom system 104 to support a lifted load, for example. The guide assemblies 142 may also be configured to maintain the location of the lines 110 relative to the boom system 104 and relative to each other. Moreover, the guide assemblies 142 may be adapted to allow the lines 110 to be paid out or hauled in while continuing to perform the load transfer function and the line position functions already mentioned.

The guide assemblies 142 may be arranged near the base 102 of the crane 100 and along the length of the boom system 104. As shown in FIG. 2, a guide assembly may be provided at or near the boom tip 132, on either sides of the knuckle or knuckle pivot point 130, and near the intersection of the inner boom 118A with the base 102 of the crane 100. As such, four guide assemblies 142 may be provided. Fewer or more guide assemblies 142 may be provided and may be configured to accommodate geometric changes in the boom 118 geometry to provide suitable line support. More discussion of this is provided with respect to FIGS. 23 and 24 below.

Figure 5:
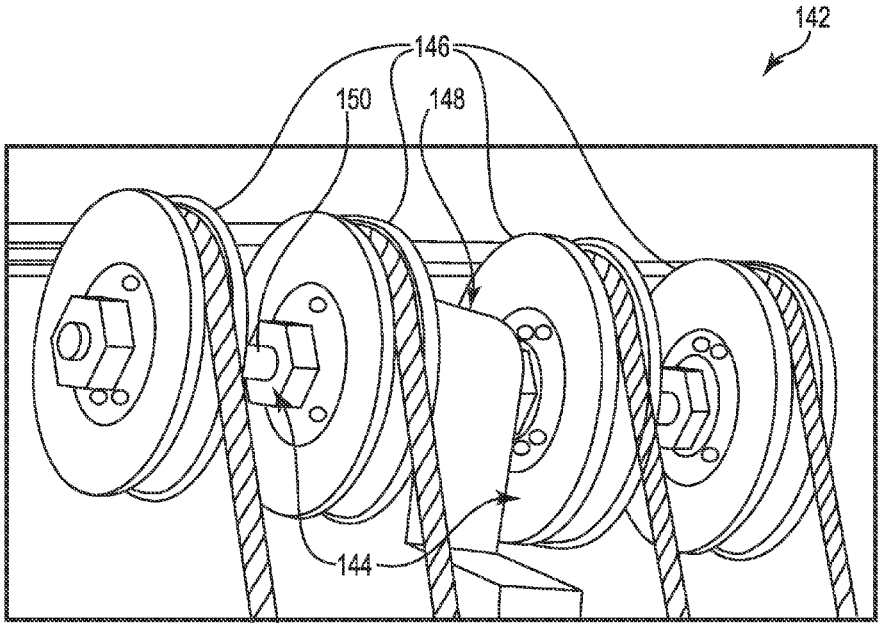
FIG. 5 is a close-up view of a guide assembly of the model crane of FIG. 1.

Referring to FIG. 5, the guide assemblies 142 may include a rack structure 144 and one or more line guides 146. The rack structure 144 may be adapted to support the line guides 146 relative to the boom 118 or other attachment point and the line guides 146 may interface with the lines 110 of the material handling system 106 to maintain their respective positions, transfer load to the rack structure 144 from the lines 110, and allow the lines 110 to be paid out or hauled in. In the embodiment, shown, the rack structure 144 may include a standoff bracket 148 or plurality of standoff brackets 148 and a bridging element 150. The standoff bracket 148 may be coupled to the boom 118 or other support surface and the bridging element 150 may extend laterally relative to the boom 118, for example, to support a plurality of line guides 146.

In one embodiment, as shown, the rack structure 144 may include a standoff plate or ear 148 and the bridging element 150 may include a spindle, shaft, or other laterally extending element for supporting the line guides 146. The bridging element 150 may be flexurally designed to extend from the supporting standoff plate 148 and support the line guides 146 at positions laterally offset from the standoff plate 148. Where multiple standoff plates 148 are provided, the bridging element 150 may support line guides 146 between the standoff plates 148 and/or beyond the standoff plates 148. The line guides 146 may be spaced along the bridging element 150 in spaced apart relationship and the spacing of the line guides 146 may define the spacing of the lines 110 extending along the boom 118. In some embodiments, depending on the hook block geometry, the line guides 146 may be spaced to match the spacing between the outgoing and incoming portions 136, 138 of a line 110 as it enters and leaves the hook block 134. For example, as shown in FIG. 3, the spacing measured substantially perpendicular to the boom 118 between an outgoing line 136 and an incoming line 138 may be equal to the throat diameter of a hook block sheave plus the line diameter. Where two hook block sheaves are provided for each incoming 138 and outgoing line 136, the spacing measured substantially perpendicular to the boom 118 between an outgoing line 136 and an incoming line 138 may be equal to the throat diameter of the hook block sheaves, plus the spacing between the center of the sheaves, plus the line diameter. While other spacings may also be provided, the described spacing may preserve the geometry of the lines 110 entering and exiting the hook block 134 and may be advantageous to maintain the lines 110 in alignment with the line guides 146 on the boom tip 132 and reduce tendencies for the line to walk off of the guides 146.

In one embodiment, as shown, the line guides 146 may include sheaves, pulleys, or other rotating line guides 146. The sheaves or pulleys may be arranged for substantially free rotation on the bridging element 150 and may include a bearing or series of bearing allowing for rotation of the line guide 146 as the line 110 is paid out or in hauled. Alternatively, the lines guides 146 may be sleeves, slots, grooves, or otherwise shaped guiding structures that allow the lines 110 to pass therethrough. In some embodiments, the line guides 146 may be lined with a low-friction slip material to allow the line 110 to pass along the guide 146 and minimize friction thereon.

Figure 6:
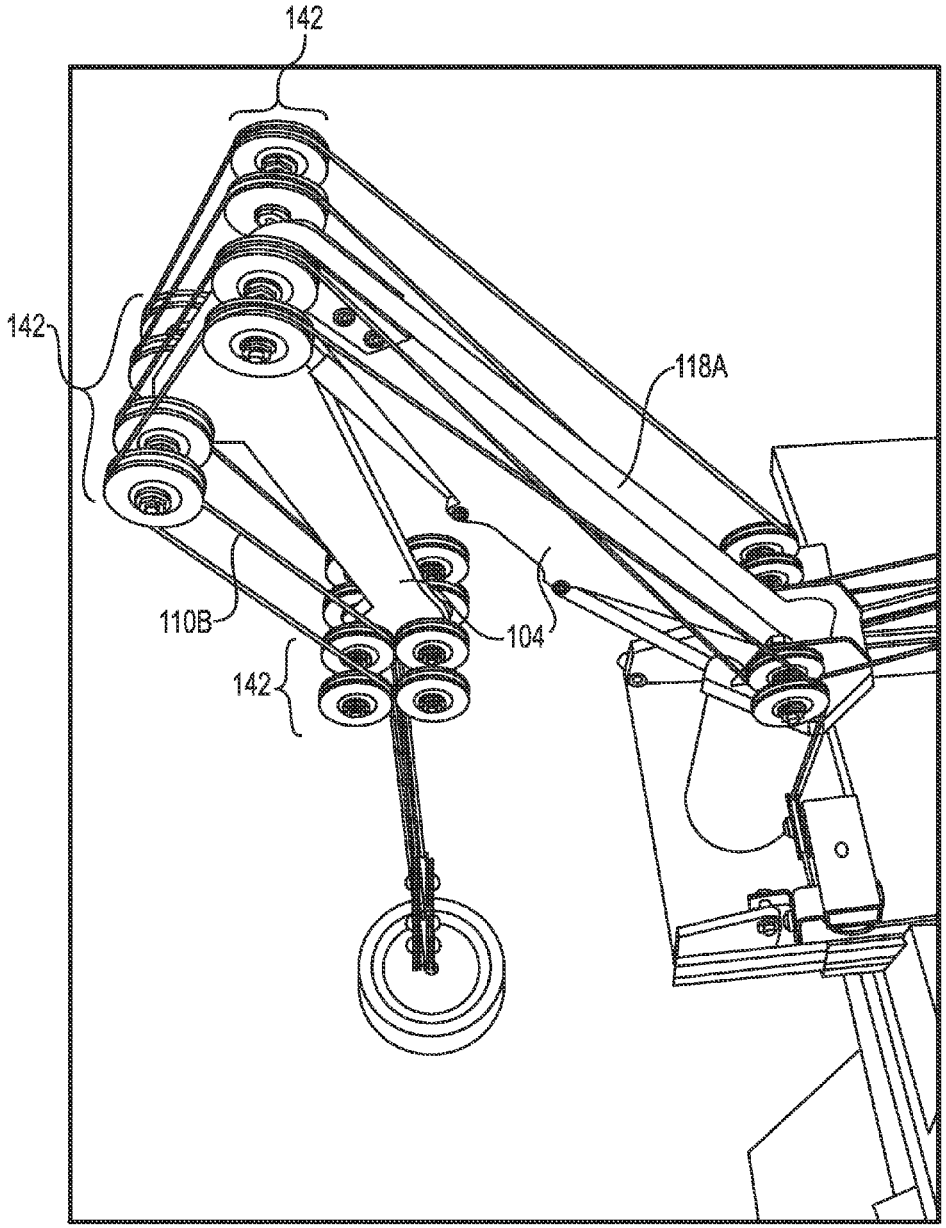
FIG. 6 is another view of the model crane of FIG. 1 with the outer boom in an inverted position.

The guide assembly 142 at the boom tip 132 may be adapted to guide and support the lines 110 of the material handling system 106 in a plurality of positions. In some embodiments, the guide assembly 142 at the boom tip 132 includes an over and under rack structure 144 with associated line guides 146. As such, when the outer boom 118B is arranged as shown in FIGS. 1 and 2, the lines 110 may be generally supported by the under rack structure 144 and associate line guides 146. When the outer boom 118B is pivoted inwardly relative to its position in FIGS. 1 and 2, the outer boom 118B may become inverted below the inner boom 118A as show in FIG. 6. This may cause the line 110 extending to the hook block 134 to hang from the over rack structure that has now moved to a position below the line 110. This again exemplifies the obstacles involved in routing multiple lines along a knuckle boom crane. That is, not only does the crane 100 have multiple articulating booms in contrast to single boom cranes, but one of the booms of a knuckle boom crane may actually be inverted below the other boom. An arrangement of line guides 146 for multiple lines 110 is provided here to accommodate the relatively involved motions of a knuckle boom crane.

Figure 22:
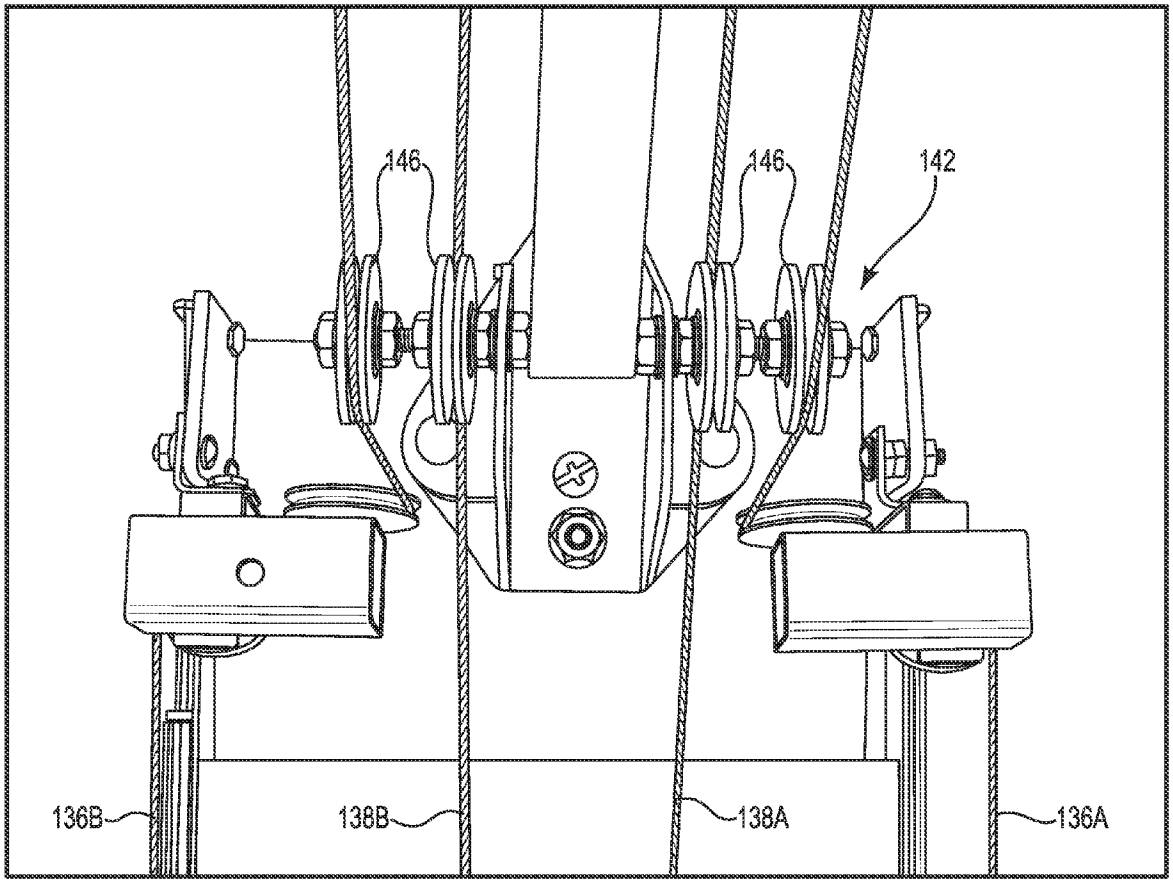
FIG. 22 is a close up view of the line routing system of the model crane of FIG. 1.

The guide assemblies 142 at the base 102 of the boom system 104 may be adapted to accommodate lines 110 extending in multiple directions. In other embodiments, the lines may all extend generally in the same direction. The guide assembly 142 may include a rack structure 144 and a bridging element 150 and the lines 110 may extend over the line guides 146 or under the line guides 146 depending on the direction the lines 110 extend when leaving the base 102 of the crane 100. As shown in FIGS. 1, 2, 3, and 6 and in close-up in FIG. 22, the inner two lines 110 extending down along the inner boom 118A are incoming portions 138 of respective lines 110. These incoming lines 138 may extend generally horizontally as they leave the base 102 of the crane and, as such, the lines 110 may extend below their respective line guides 146. The outer two lines 110 are outgoing lines 136 and may extend generally downward as they leave the base 102 of the crane 100 and extend toward the winch 112. As such, these lines 110 may extend over their respective lines guides 146. The outgoing portions 136 may proceed around an additional set of line guides leading back to the location of the winches 112 associated with each line 110. This additional set of line guides 146 may be adapted to accommodate rotation of the base of the crane 100 and the several lines 110 passing through this area. In some embodiments, some of the line guides may be positioned on swing arms or other pivoting or rotating fixtures to accommodate the varying location of the lines 110 as the lower most guide assembly 142 rotates with the crane 100.

In other embodiments, as shown in a series of FIGS. 8-21, the lines 110 may pass across the top of the line guides 146 at the base 102 of the crane 100. In some embodiments, the lines 110 may pass generally down and through the supporting pedestal 50 and rotation of the crane may be accommodated by a system of routing guides 143, 145 the same as or similar to the guide assemblies 142.

Figure 8:
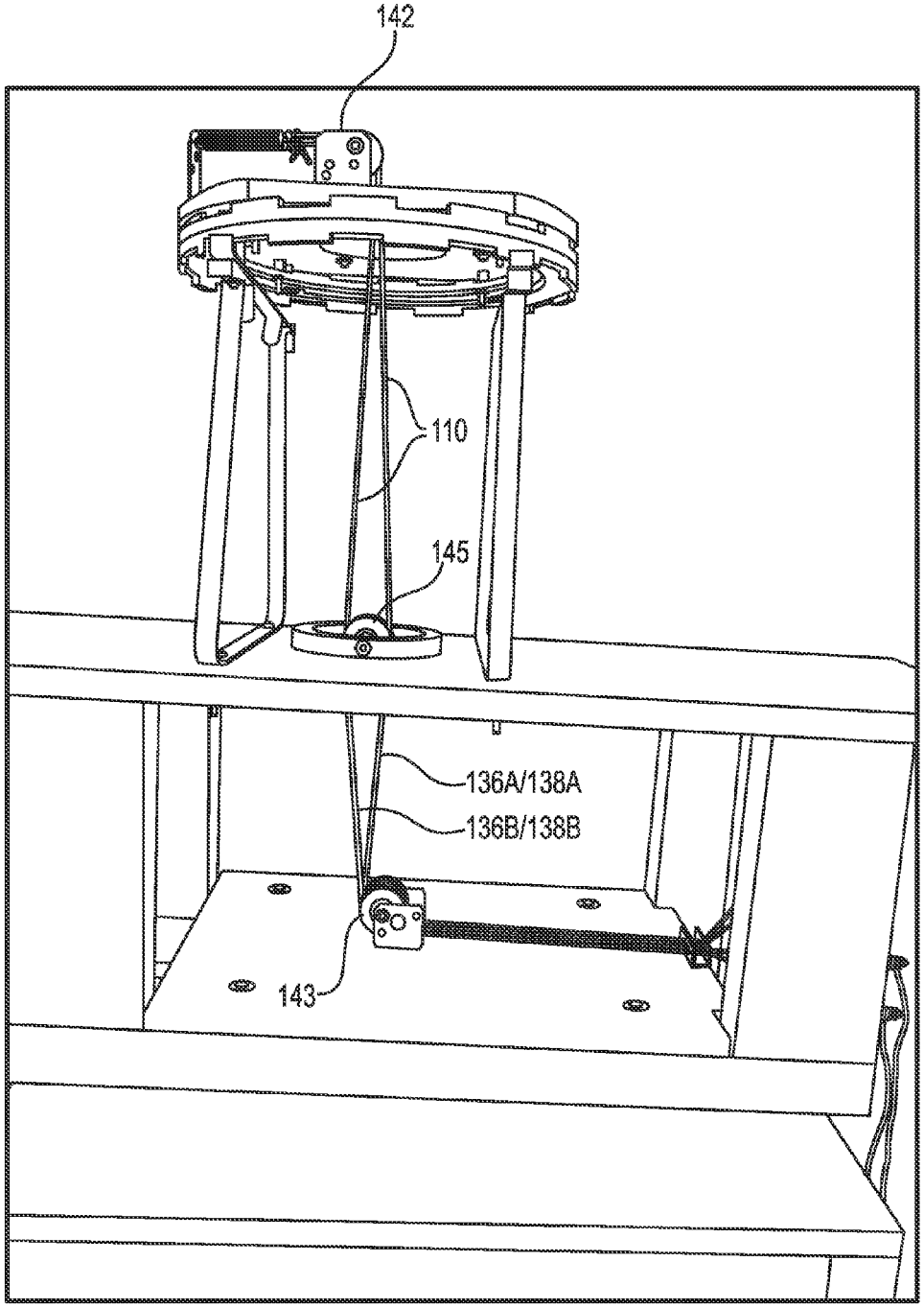
FIGS. 8-21 show a line routing system for arrangement below the base of the model crane of FIG. 1.
Figure 9:
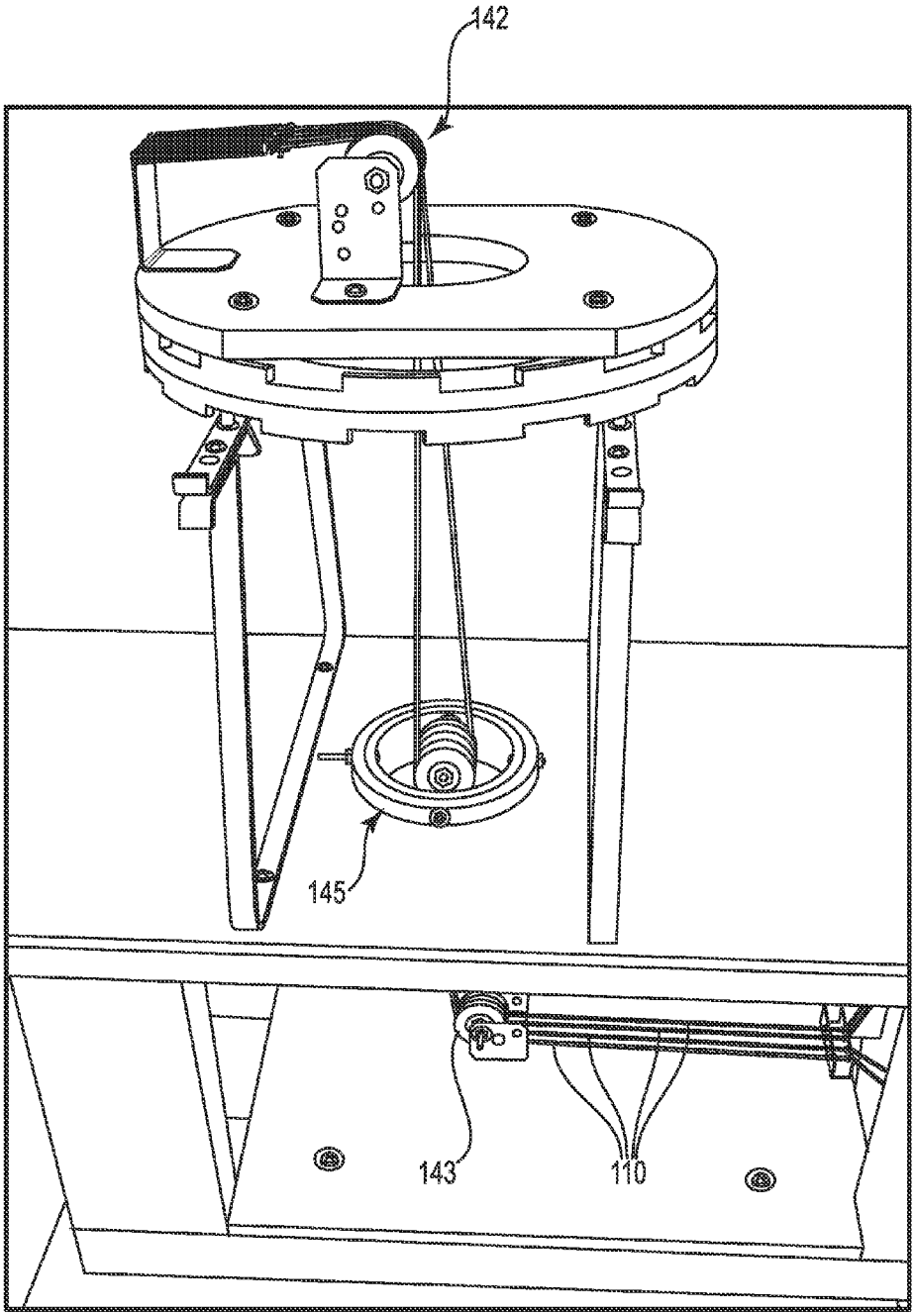
Figure 10:
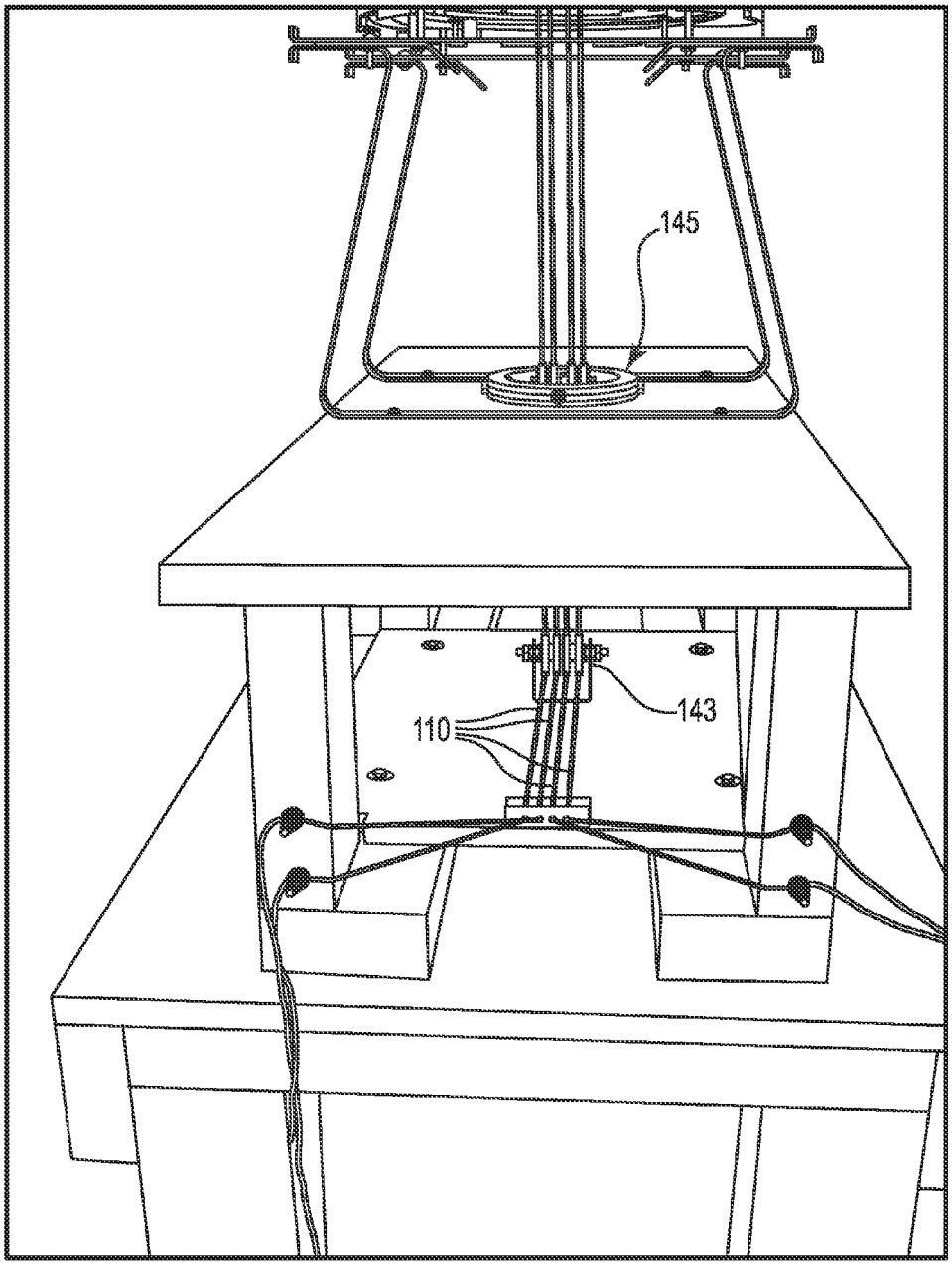
Figure 11:
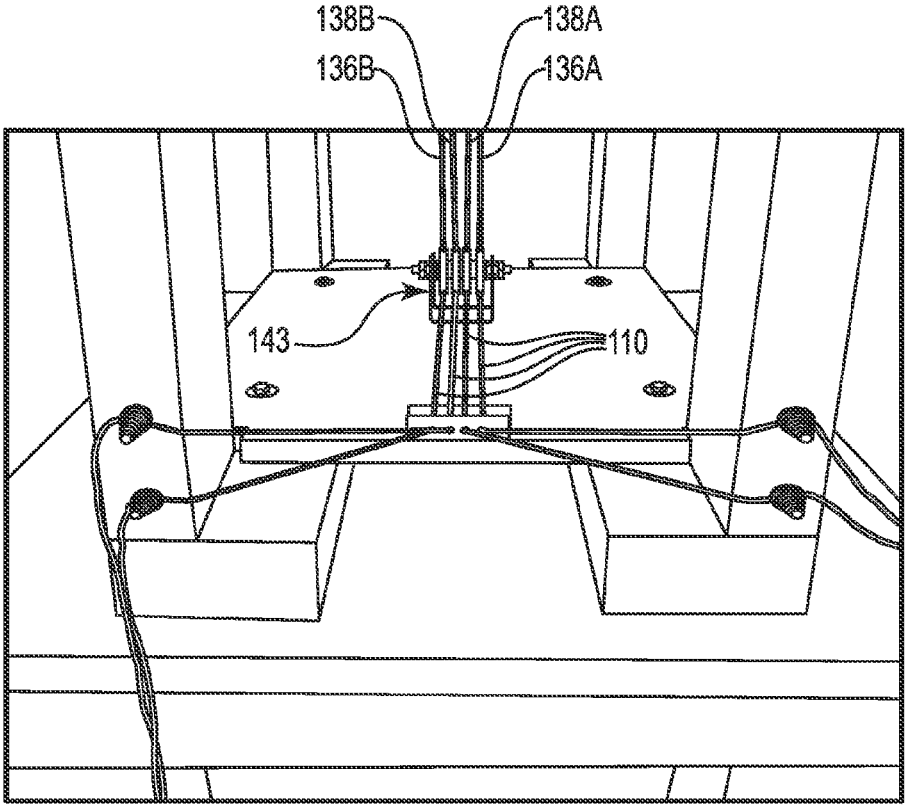
Figure 12:
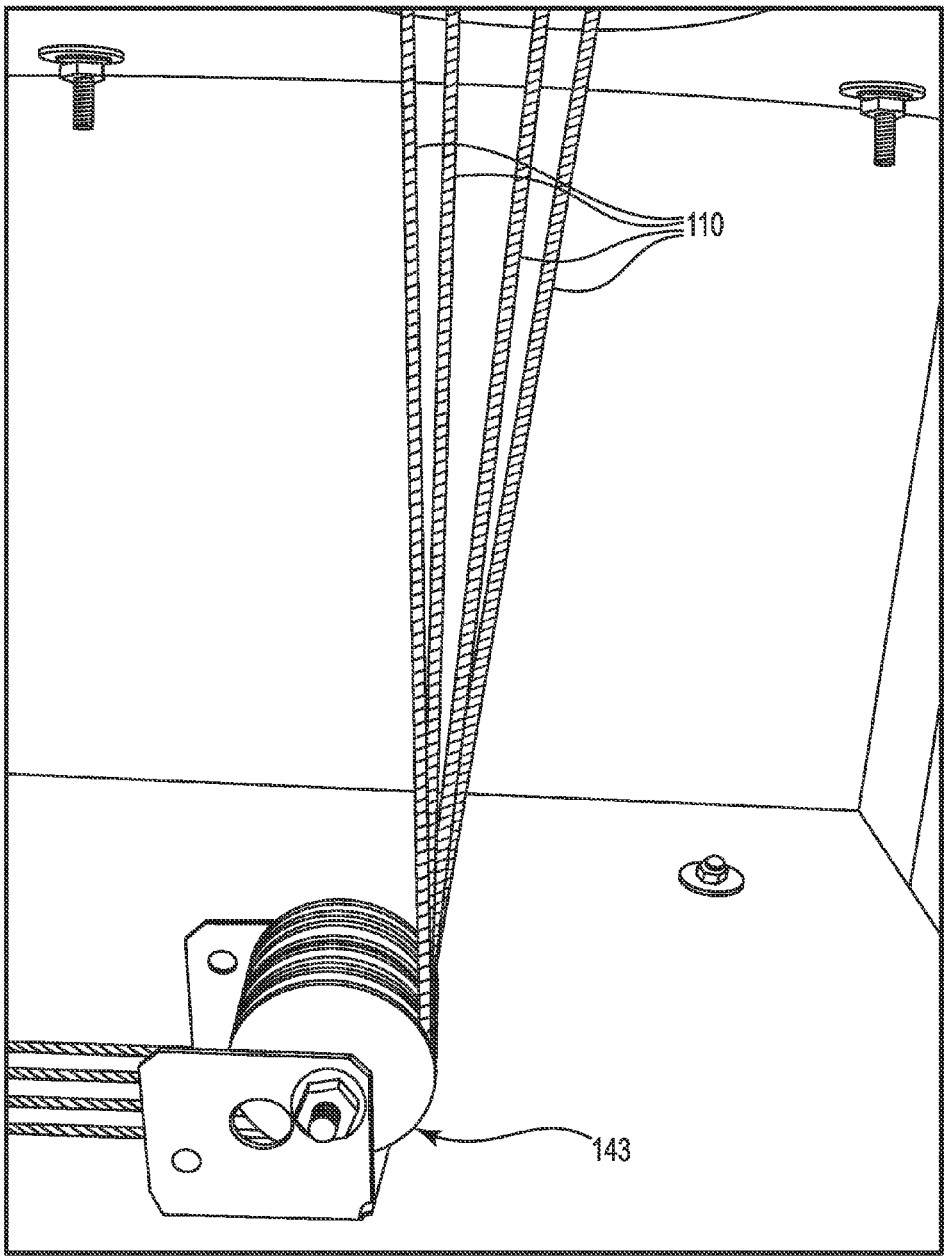
Figure 13:
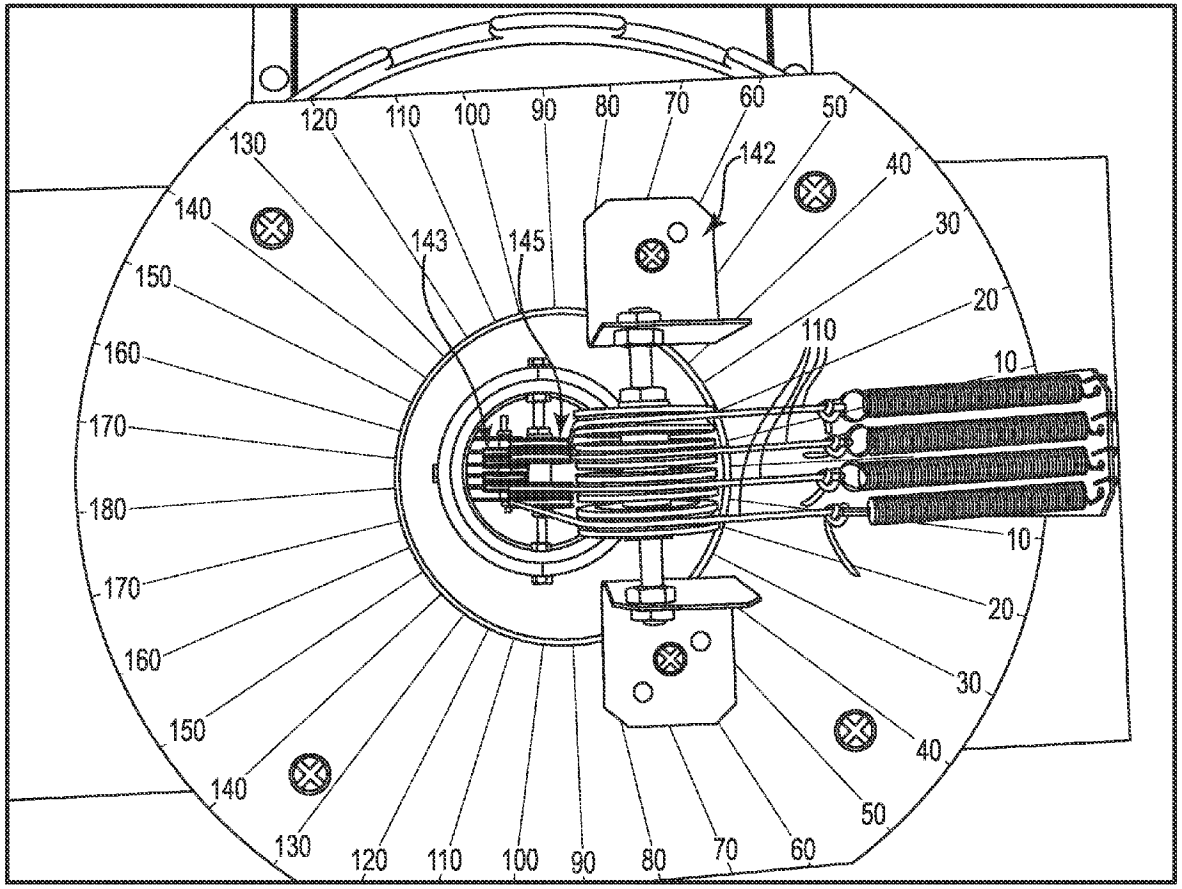
Figure 14:
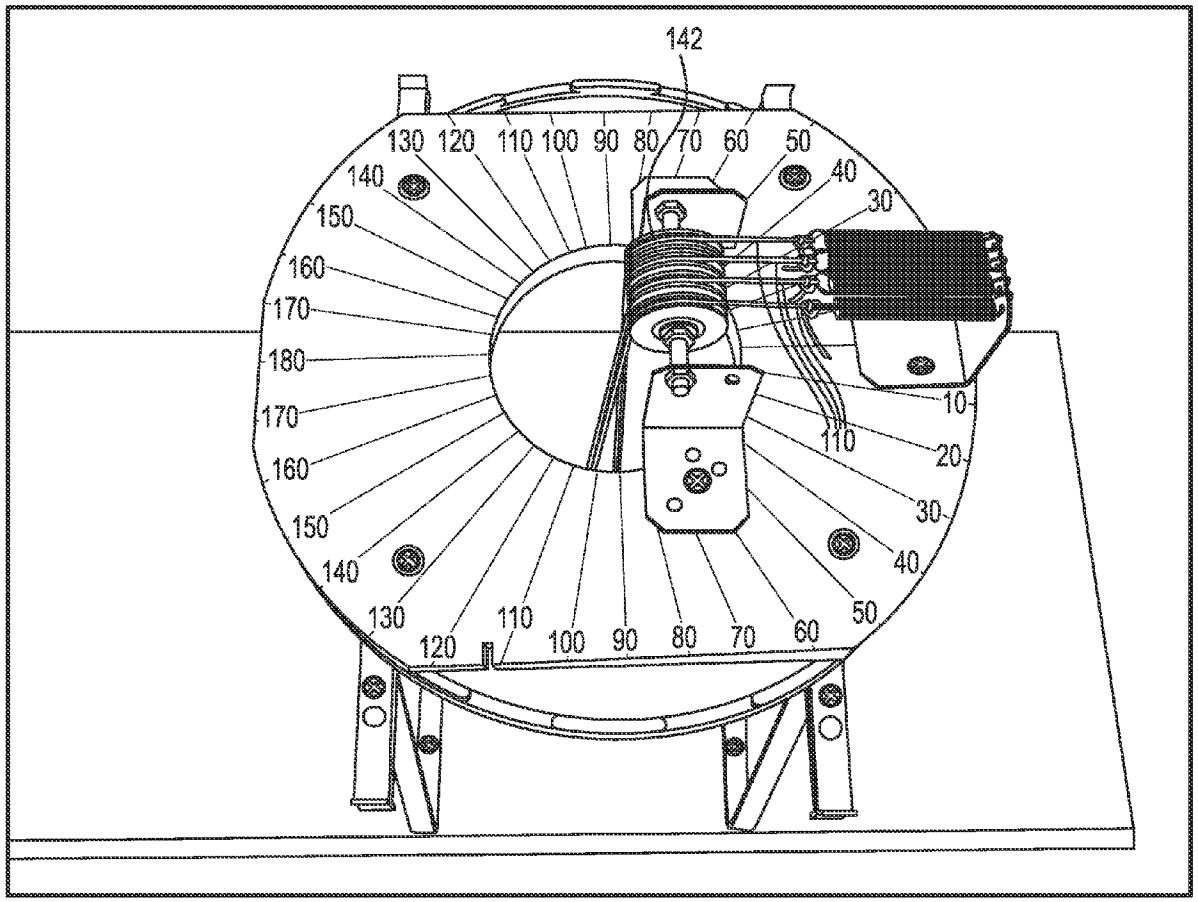
Figure 15:
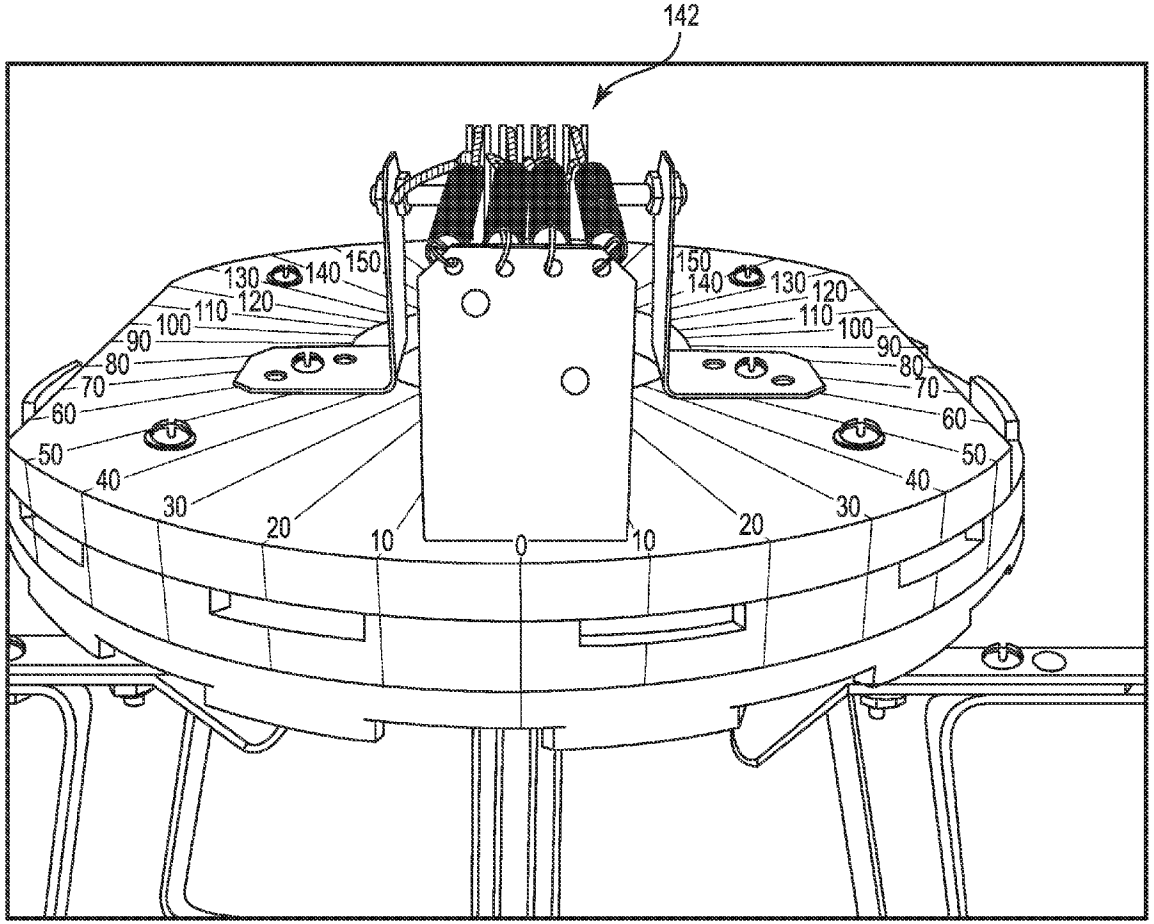
Figure 16:
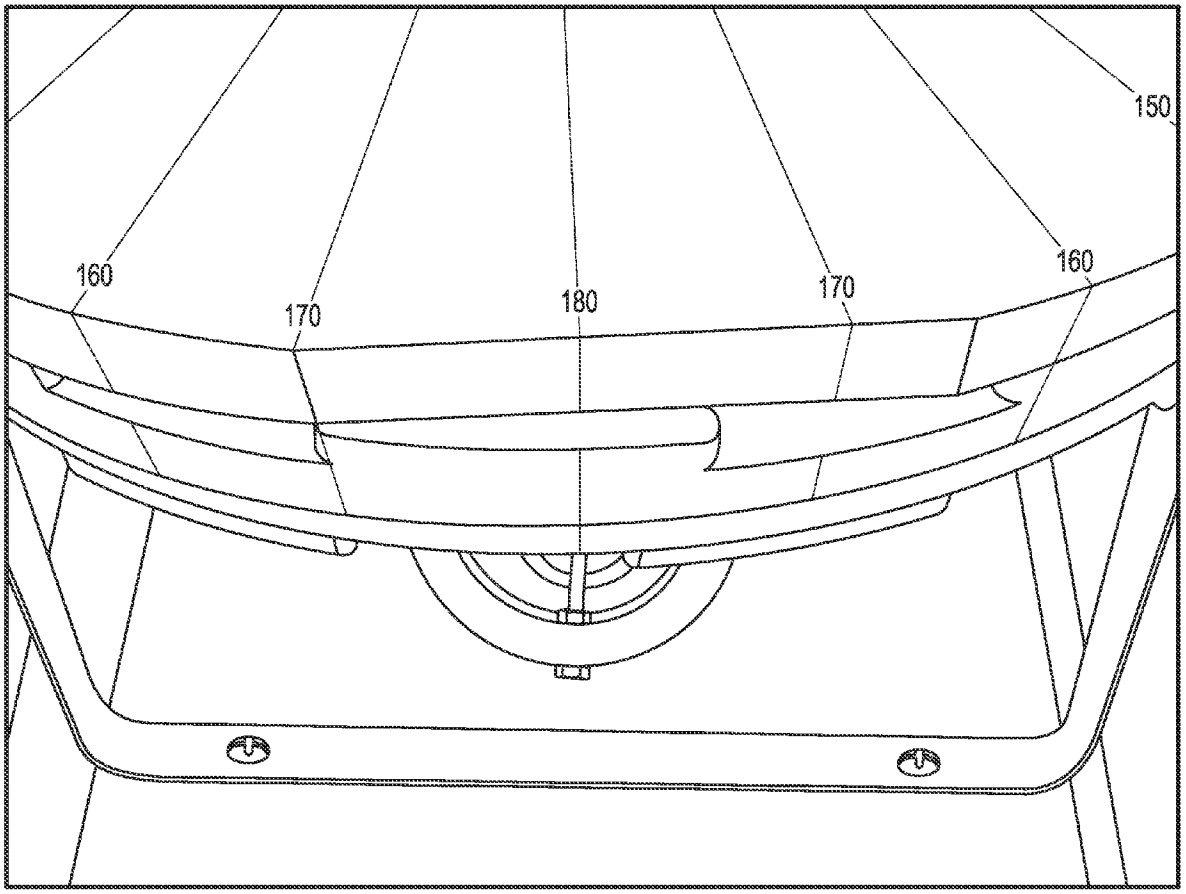
Figure 17:
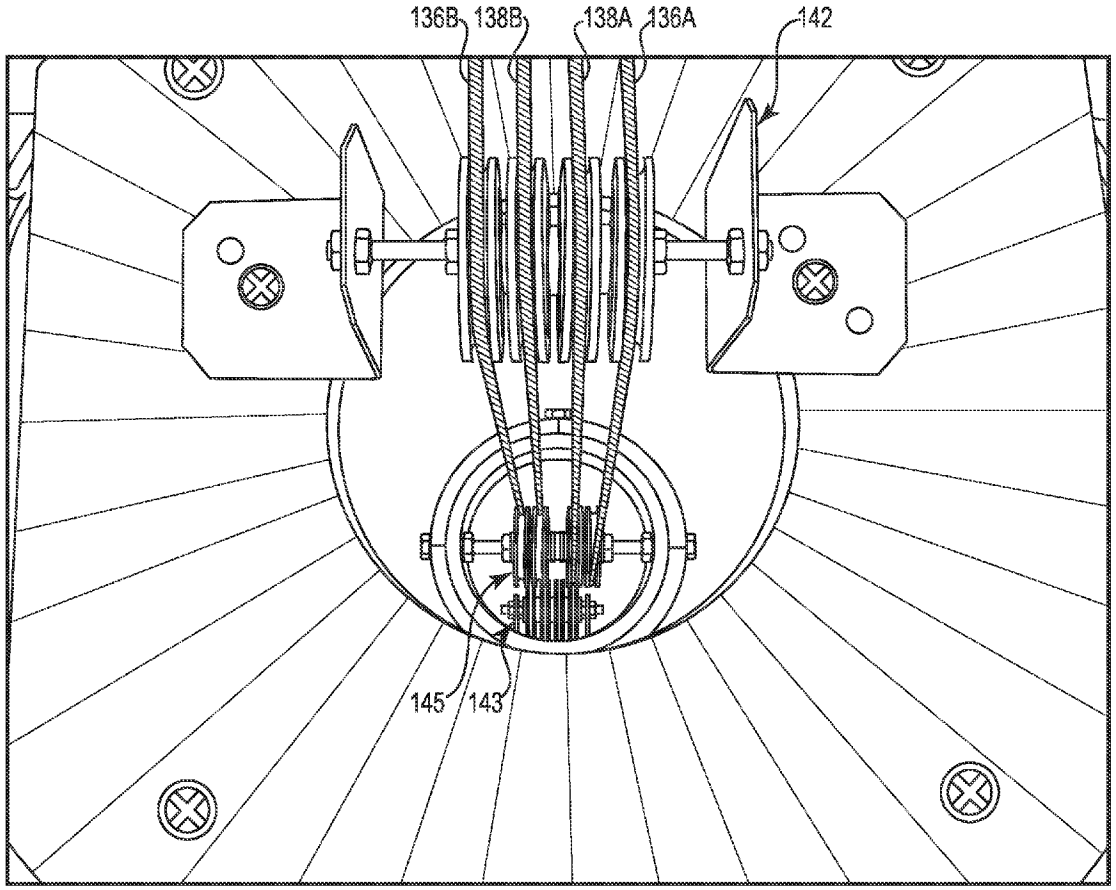

As shown in FIG. 8, for example, the lines 110 may be routed from the guide assembly 142 at the base of the crane to a routing guide 143 located below a ship deck. It is noted that the crane booms have been omitted for clarity and the springs shown are for simulating the tension on the lines due a load suspended from the crane. In some embodiments, an intermediate or mid-span routing guide 145 may be provided. As shown in FIG. 17, for example, a first outgoing portion 136A and incoming portion 138A of line may extend along one side of the intermediate routing guide 145 and a second outgoing portion 136B and incoming portion 138B of line may extend along an opposing side of the intermediate routing guide 145. Referring again to FIG. 8, all of the incoming and outgoing portions 136A/B, 138A/B of the two lines may then pass along the same side of the routing guide 143, pass underneath the routing guide 143 and extend to a hoist or anchor device. (i.e., outgoing portions 136A/B may extend to a hoist and incoming portions 138A/B may extend to an anchor device 140.)

The intermediate or mid-span guide 145 may be adapted to rotate some fraction of the rotation of the crane and the guide assembly 142 at the base of the crane. For example, in some embodiments, the intermediate guide 145 may rotate half of the rotation of the crane. When the crane rotates 60 degrees about the pedestal, the intermediate guide 145 may, for example, rotate 30 degrees. In other embodiments, other fractions may be used, such as ¼, ⅓, ⅜, ⅝, ¾, or some other fraction of the crane rotation. The control system of may allow for input of the selected fraction or the selected fraction may be coded into the control system such that intermediate routing guide rotates automatically with the crane rotation.

Figure 18:
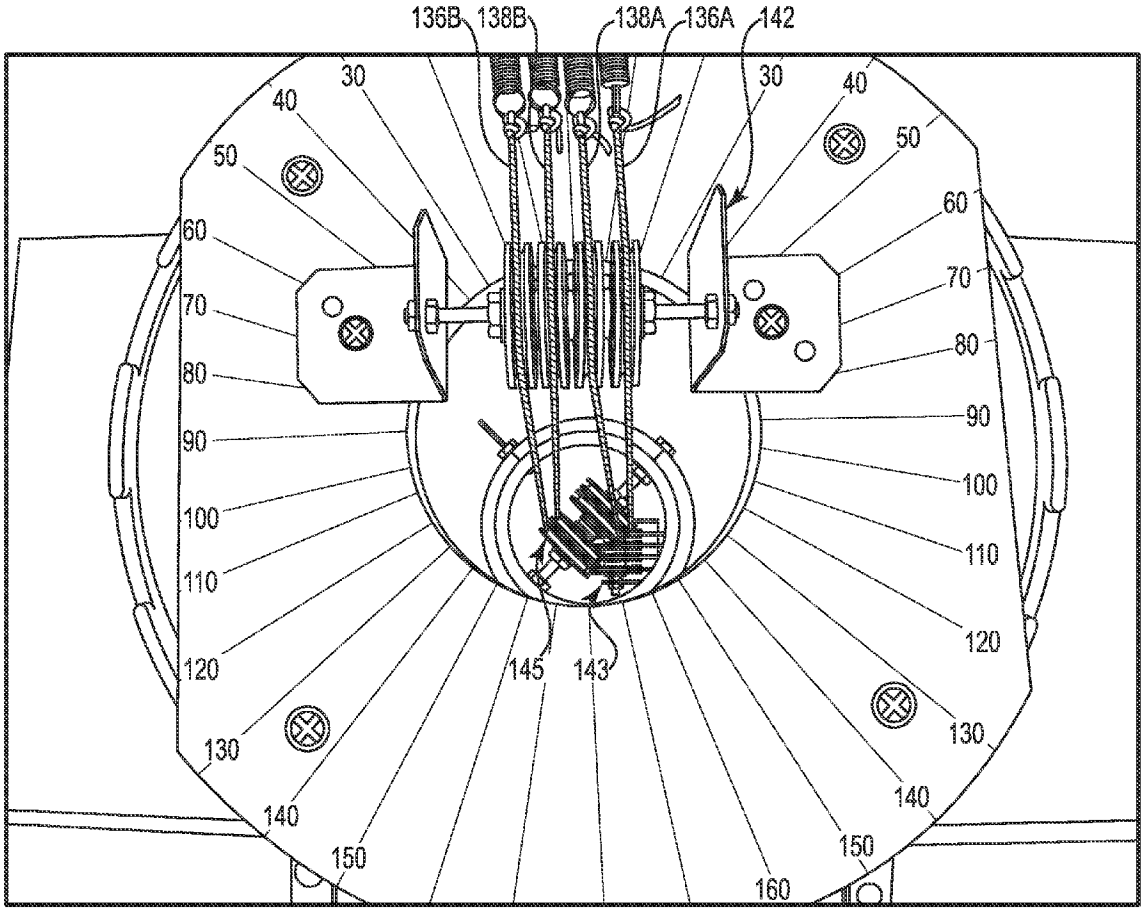
Figure 19:
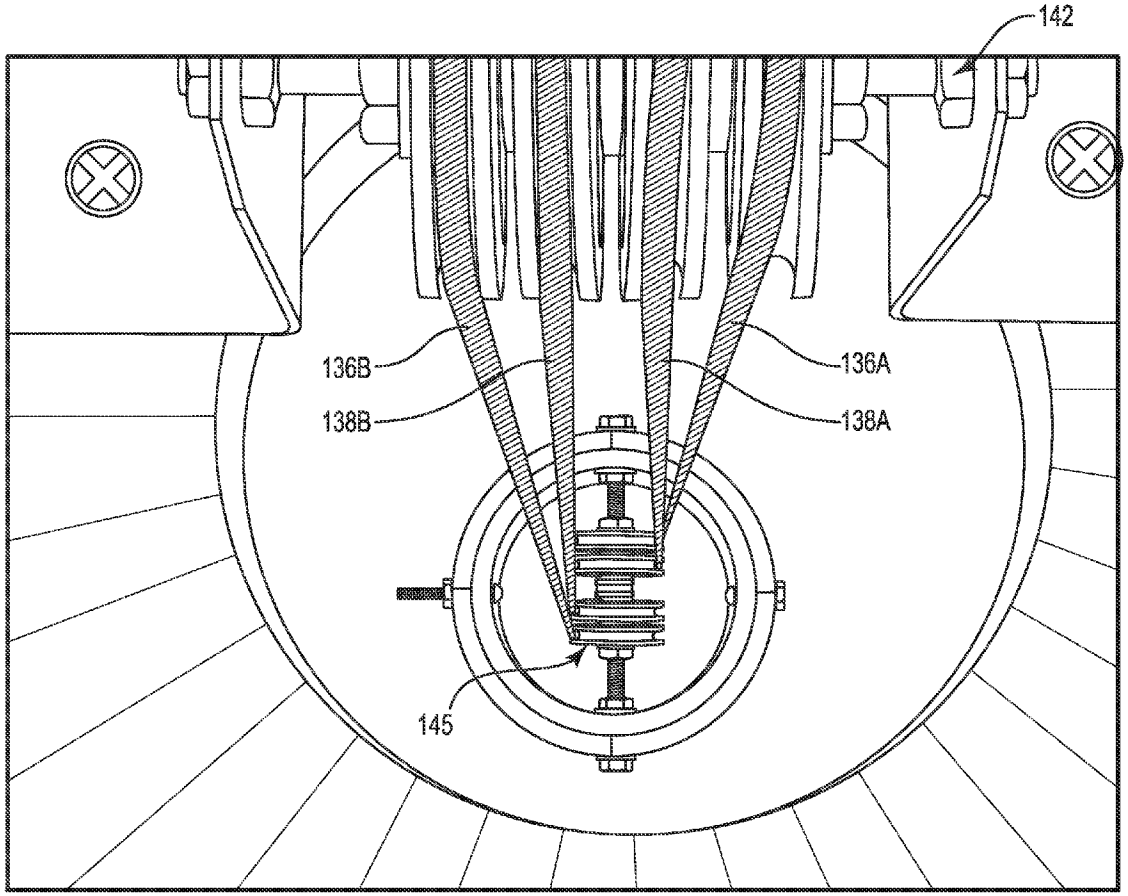
Figure 20:
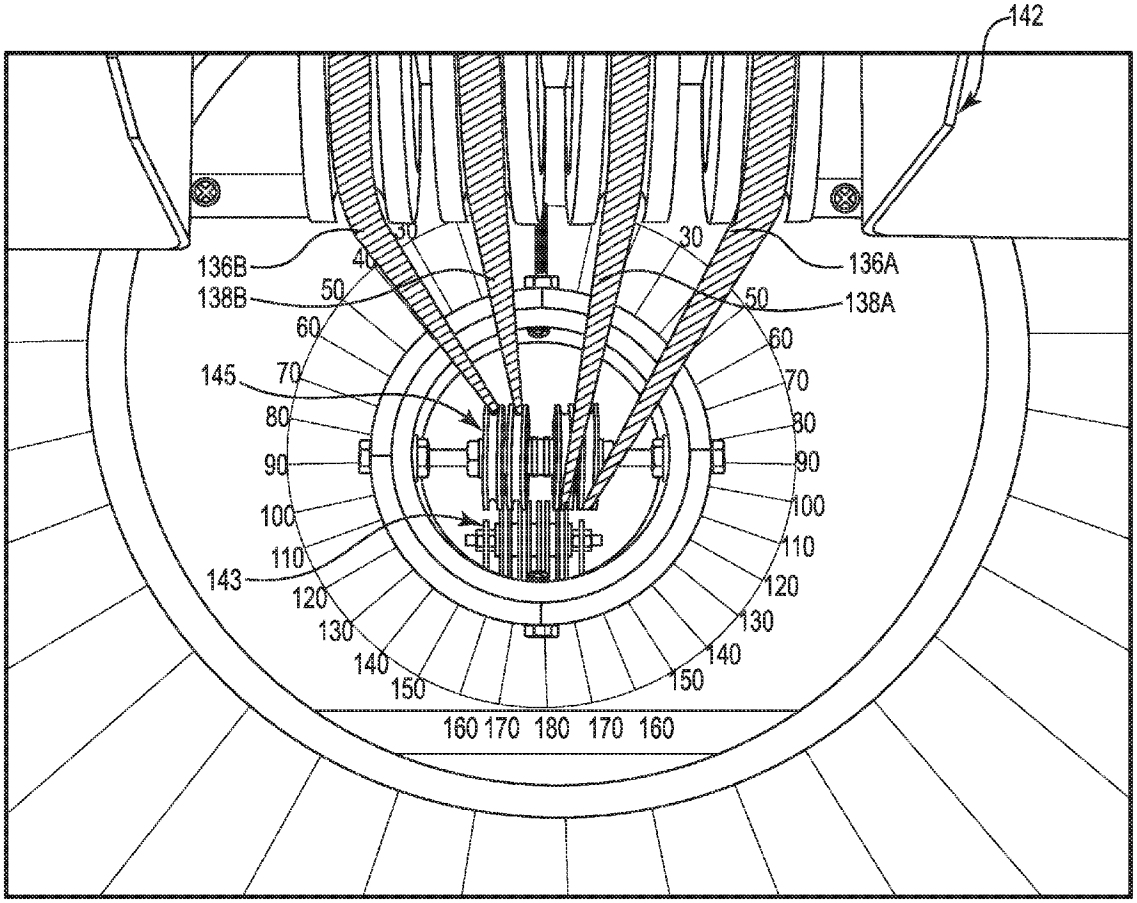
Figure 21:
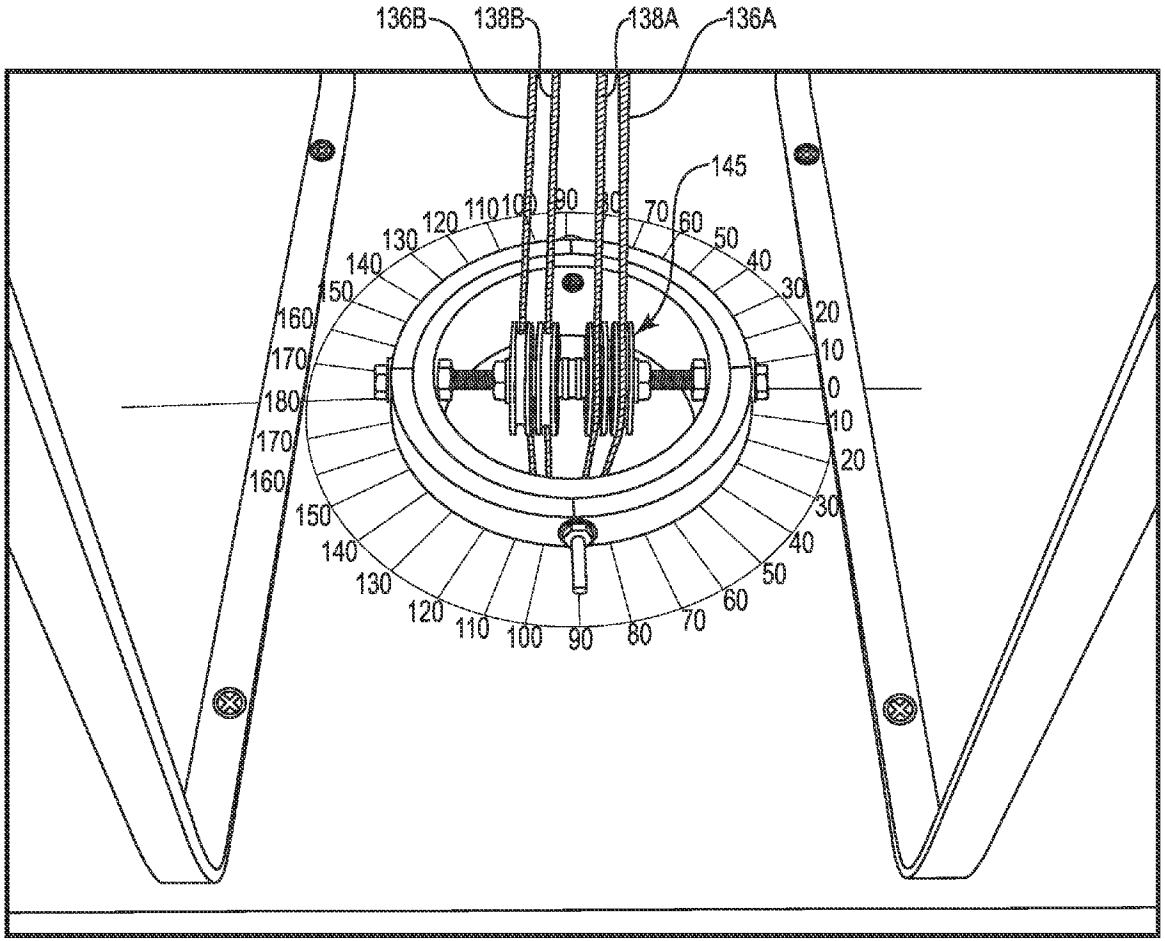

As shown in FIGS. 17-20 a series of top views of positions of the guide assembly 142 at the base of the crane relative to the routing guide 143 and intermediate routing guide 145 are shown. In FIG. 17, for example, the guide assembly 142 is aligned with the routing guide 143. In FIG. 18, the guide assembly 142 at the base of the crane has rotated approximately 90 degrees relative to the routing guide 143 and the intermediate guide has rotated approximately 45 degrees. In FIG. 19, further rotation of the guide assembly 142 has occurred and the guide assembly 142 is shown positioned approximately 180 degrees from its original position and thus 180 degrees relative to the routing guide 143. The intermediate guide 145 has rotated approximately 90 degrees from its original position. As can be appreciated, without the intermediate guide 145, if the guide assembly 142 were to rotate 180 degrees relative to the rouging guide 143, the lines would cross causing line fouling. With the intermediate routing guide 145, relative rotations between the guide assembly 142 and the routing guide 143 up to and exceeding 180 degrees may be provided. Accordingly, where the crane can rotate 180 degrees or more in each direction, a full 360 degree range of motion may be provided without fouling of the lines extending from the base of the crane.

Anchor Device

As mentioned, the incoming lines 138 of the multi-line system may return from the hook block 134 to an anchor device 140. In the embodiments shown, the anchor device 140 is located off of the crane 100 and may be located below a ship deck, for example. However, it is noted that the anchor device 140 may be at any point near or inward from the boom tip 132 where support to the incoming lines 138 may be provided. In some embodiments, the anchor point for one incoming portion 138 may be different than the anchor point for another incoming portion 138. In other embodiments the anchor point may be the same or may be on the same device 140.

In the embodiment shown, the anchor device 140 may include a substantially free rotating pulley or sheave and in some embodiments, the free pulley or sheave may be an equalizer pulley or drum-style equalizer. Each of the incoming line portions 138 may be wrapped on an equalizer sheave or pulley in opposite directions, and the respective free ends of the lines 110 may be secured to the sheave or pulley. As the two winches 112A and 112B pay out or in haul line, if the outgoing portions 136 of the respective lines 110 are paid out or in hauled at the same rate, the tension on the incoming portions 138 of the respective lines 110 may be substantially equal. When an outgoing portion, portion 136A for example, is paid out faster than the other 136B, the other incoming portion 138B may begin to carry more load and thus pull on the equalizer sheave or pulley. Sensors may be provided on the equalizer sheave or pulley for automatic monitoring of the line payout, for example, such that the slower winch, for example, may be sped up or the faster winch may be slowed down. A similar approach may also be used when in hauling line. Other anchor devices 140 may also be provided and equalization may be included. For example, a translating anchor device associated with each incoming line may be provided or a separate winch and drum may be provided for each incoming line for example. Still other anchor devices may be provided to support the loads imposed by the incoming lines and compensate for uneveness in the inhauling or paying out of the two lines in the system such that the hook block may remain substantially level and the load from the hook block may be substantially evenly distributed between the two systems of outgoing and incoming lines.

In still other embodiments, a heave compensation mechanism 160 may be provided and incorporated into the support for the anchor point and/or equalizer sheave or pulley. As shown in FIG. 7, for example, a heave compensation mechanism 160 may be provided by allowing for translation of the anchor point and/or equalizer sheave or pulley. That is, as a ship, for example, experiences upward wave heave motion, the anchor point may translate toward the base of the crane 100 to provide excess incoming portion 138 of the line 110. As the ship, for example, descends into a wave trough, the anchor point may be returned to its previous position to take-up the amount of the incoming portion 138 of the line 110 that was just provided for the upward heave. As such, the material, equipment, or other item that is suspended by the hook block 134 may be held substantially stationary.

The crane 100 may be controlled by an operator and/or a computer control device. The control device may include a computer-type device including a computer readable storage medium and a processor. The control device may include computer implemented instructions stored on the computer readable storage medium for performing several operations. The operations may include sensing of the equalizer and directing the winches to run at corrective speeds. The operations may also include performing heave compensation processes responsive to sensors that sense wave motion accelerations and the like. The operations may also include directing crane motions responsive to operator commands via joysticks or other operator interfaces. The control device may, thus, control the direction of the winches and the speed the winches run. The control device may also control the pumps and valves associated with the hydraulics on the boom system 104 and may also control the motors associated with rotating traction devices that allow for rotation of the crane 100 about the supporting pedestal for example.

In use, an operator may rotate the crane 100 such that the boom tip 132 is above or near material to be picked up or otherwise handled. The boom system 104 may be manipulated to locate the boom tip 132 approximately directly above a pick point on the material. The boom tip 132 may also be lowered to reduce the pendulum length of the line 110 suspended from the boom tip 132. Line 110 may be paid out to approach the material with the hook block 134 and the material may be slung to the hook on the hook block 134. Line 110 may be in hauled to lift the load or the boom system 104 may be manipulated to lift the load. The crane 100 may swing by rotating the base 102 relative to the pedestal 50, the boom system 104 may be manipulated to move the load radially toward or away from the pedestal or to raise or lower the load, and line 110 may be paid out to lower the load to a new location.

In some embodiments, the load may be picked from the deck of ship for example and the crane 100 may rotate to swing the load out over the side of the ship. The line 110 may be paid out to lower the material into the water and down to the ocean floor, sea bed, river bottom, or other underlying structure or location. It is noted that he crane capacity may be a substantially fixed value based on an assumed boom path envelope or the capacity may vary depending on several boom positions. However, as line is paid out and with the capacity of the crane remaining substantially constant, the amount of material that can be lowered to the ocean floor may be reduced. For example, a 800 metric ton crane may have capacity to lift a 800 metric ton load with little line paid out. However, due to the dead load of the line on the crane, if the 800 metric ton crane is used to lower material to a depth of 3500 meters, the weight of the material may be limited to a weight lower than 800 metric tons and may be more like 500 metric tons. The remaining 300 metric tons may be the weight of the line. Other relationships between overall capacity and capacity at depth may be provided and may vary depending on the type of line being used and weight of the line.

It is noted that in the multi-line system described, the winch speeds may be approximately double that of a single line system. That is, in the single line system, each unit of line 110 paid out may be equal to the distance that the suspended material drops. In the described four-line system, each unit of line 110 paid out is equal to twice the distance that the suspended material drops. That is, to get a suspended load to fall 1 meter, 2 meters of line 110 must be paid out. As such, the winches of the current system may be geared to run faster (i.e., approximately twice as fast) than those of a single line system. However, the amount of power generated by the winches 112 is approximately the same because the forces for each winch are approximately ½ of a single line system.

In some embodiments, the winches 112 may be associated with an energy dissipation system for use in high-speed payout situations or other situations. In these embodiments, the winches 112 may include a transmission the same or similar as that described in U.S. Pat. No. 7,487,954, the content of which is hereby incorporated by reference herein, in its entirety.

Figure 23:
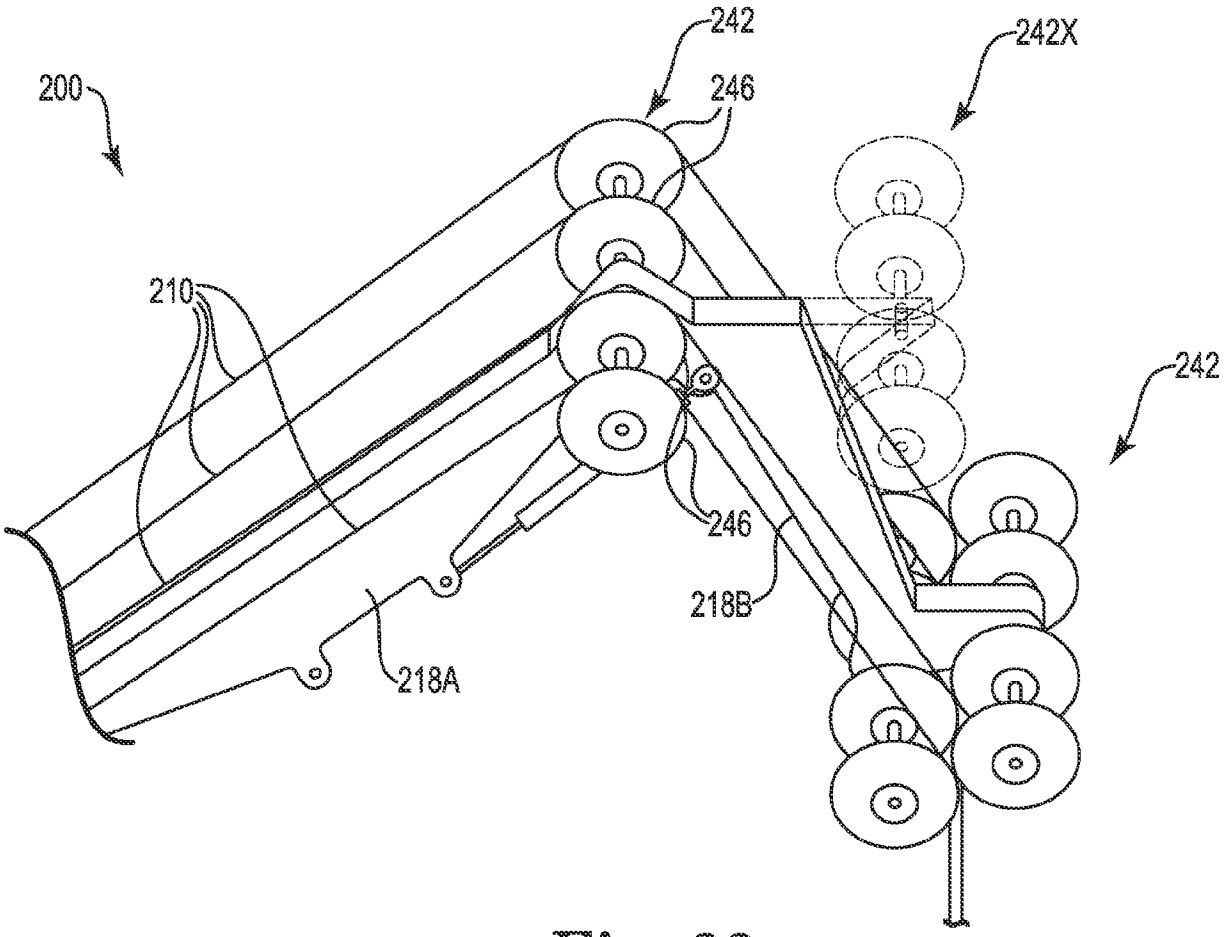
FIG. 23 shows another embodiment of a knuckle boom crane with fewer guide assemblies than the knuckle boom crane of FIG. 1, according to some embodiments.

Referring to FIG. 23, another embodiment of a knuckle boom crane 200 is shown. In this embodiment, fewer sets of guide assemblies 242 are shown. For example, as shown, the guide assembly 242*x* near the knuckle arranged on the outer boom 218B has been omitted and each of the line guides 246 of the guide assembly have been offset sufficiently to guide the lines 210 of the material handling system 206 along the side of the booms 218A, 218B. As such, where previous single-line knuckle boom cranes required both sets of line guides to route the single line over the knuckle and accommodate several positions of the booms, the laterally offset lines 210 allow for the elimination of one of the guide assemblies 242 because the lines 210 may pass alongside the booms 218A, 218B and may impinge on the laterally extending plane of the boom 218A, 218B without interfering with the booms 218A, 218B themselves. As such, the lateral position of the lines 210 allows for the reduction in guide assemblies 242 which, with the previous single line approach, would have caused the single line to interfere with the boom. While the guide assembly 242*x* near the knuckle on the outer boom 218B has been shown as eliminated, the guide assembly 242 near the knuckle on the inner boom 218A may alternatively be eliminated. Other quantities and locations of guide assemblies 242 may be provided and flexibility in the number and location of the guide assemblies 242 may be provided by the offset positions of the lines 210.

Figure 24:
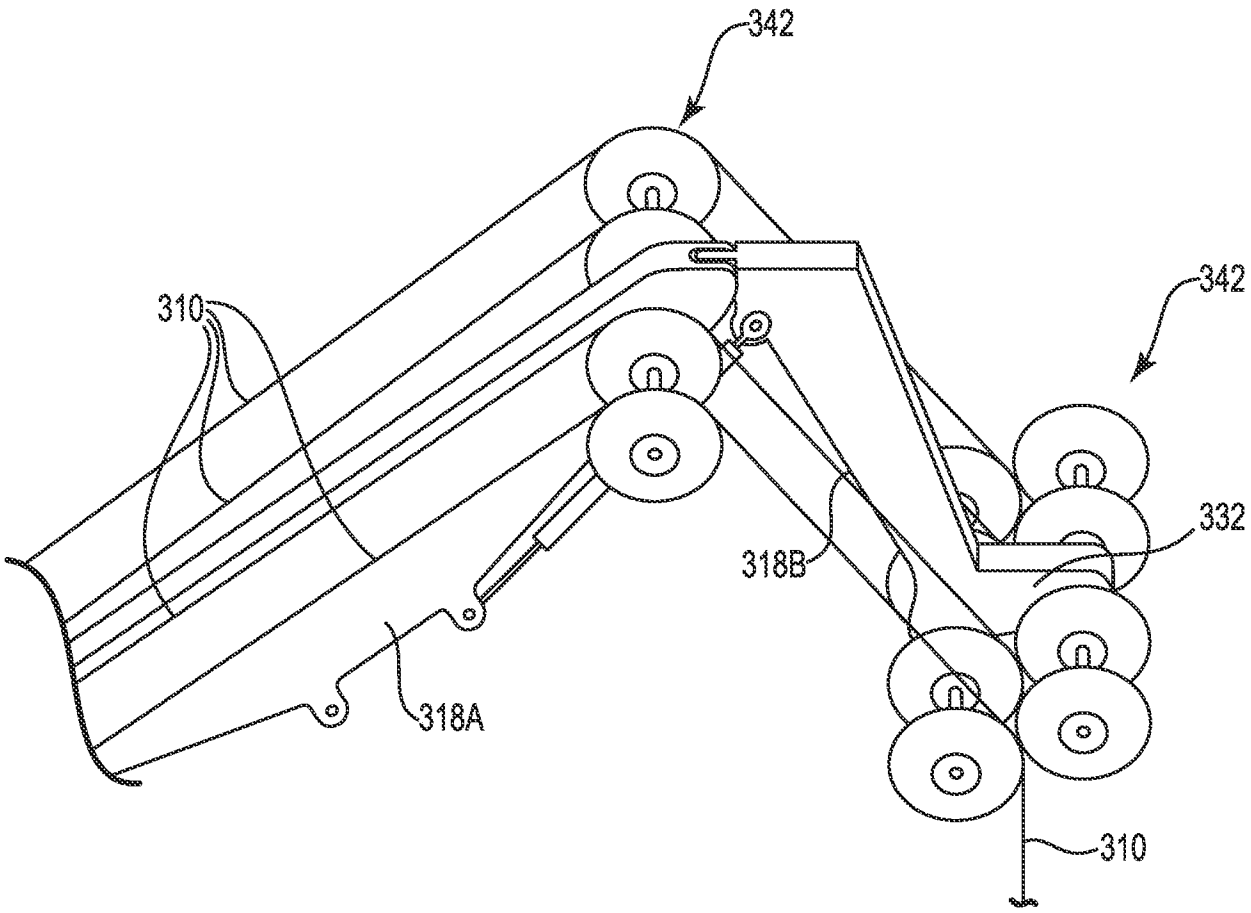
FIG. 24 shows another embodiment of a knuckle boom crane with lines being routed alongside the inner and outer boom, according to some embodiments.

Referring to FIG. 24, another embodiment of a knuckle boom crane 300 is shown. In this embodiment, the guide assembly 342 near the knuckle on the outer boom 318B has been eliminated like in FIG. 23. However, here, the guide assembly 342 near the knuckle on the inner boom 318A has also been relocated to extend through the boom 318A or be arranged on either side of the boom 318A such that the lines 310 of the material handling system 306 may extend generally alongside the booms 318A, 318B of the crane 300. The guide assemblies 342 may include a rack structure in the form of a spindle or axle similar to the guide assemblies 142 previously described, but the rack structures may extend laterally through boom 318A, 318B rather than being arranged on top of the boom 318A, 318B, for example. In other embodiments, the rack structure may include brackets cantilevered off the side of the boom 318A, 318B rather than extending through the boom 318A, 318B. While a single guide assembly 342 has been shown as being adjusted to fall within or be closer to the lateral plane of the boom 318A, other guide assemblies 342 such as the guide assembly 342 at the base of the boom 318A may also be adjusted similarly. The guide assemblies 342 at the boom tip 332 may also be adjusted since clearance of the line 310 relative to the top surface of the outer boom 318B may no longer be a controlling factor.

In the foregoing description various embodiments of the present disclosure have been presented for the purpose of illustration and description. They are not intended to be exhaustive or to limit the invention to the precise form disclosed. Other modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A knuckle boom crane, comprising:

a rotatable base;

an inner boom extending from a base end to a first knuckle end, the base end pivotally connected at a base pivot point to the rotatable base such that the inner boom is pivotable in a vertical plane about the base pivot point, the inner boom being operable during lifting operations to articulate about the base pivot point;

an outer boom extending from a second knuckle end to a boom tip, the second knuckle end pivotally connected at a knuckle pivot point to the first knuckle end of the inner boom such that the outer boom is pivotable in the vertical plane about the knuckle pivot point, the outer boom being operable during lifting operations to articulate about the knuckle pivot point;

a plurality of guide assemblies arranged along the length of the inner and outer boom and adapted for guiding a plurality of lines, each of the guide assemblies having a rack structure and a plurality of line guides arranged on the rack structure; and a multi-line material handling system, comprising:

a first line having a first end secured to a first winch drum, an outgoing portion extending along the inner and outer booms from the first winch drum and along one of the line guides of each of the plurality of guide assemblies to a sheave block, and an incoming portion extending along the inner and outer booms and returning from the sheave block to a supported anchor device; and a second line having a first end secured to a second winch drum, an outgoing portion extending along the inner and outer booms from the second winch drum and along one of the line guides of each of the plurality of guide assemblies to the sheave block, and an incoming portion extending long the inner and outer booms and returning from the sheave block to the supported anchor device.

2. The crane of claim 1, wherein the incoming portions of the first and second lines each extend along one of the line guides of each of the plurality of guide assemblies before returning to the supported anchor device.

3. The crane of claim 1, wherein the rack structure of each of the guide assemblies comprises a support bracket and a spindle.

4. The crane of claim 3, wherein the line guides are arranged in spaced apart relationship along the spindle.

5. The crane of claim 4, wherein the spindle extends transversely to the inner and outer boom.

6. The crane of claim 1, wherein the plurality of line guides comprise sheaves.

7. The crane of claim 6, wherein each of the guide assemblies includes four sheaves to accommodate the incoming and outgoing portion of the first line and the incoming and outgoing portion of the second line.

8. The crane of claim 1, wherein the first line is a right lay line and the second line is a left lay line.

9. The crane of claim 1, wherein the sheave block includes a line guide for each of the first and second lines.

10. The crane of claim 1, wherein one of the plurality of guide assemblies is arranged near the outer boom tip and comprises:

a first rack structure and a plurality of line guides arranged on a first side of the first and second lines; and a second rack structure and a plurality of line guides arranged on a second side of the first and second lines.

11. The crane of claim 1, wherein the supported anchor device is an equalizing device.

12. The crane of claim 11, further comprising a monitoring system in communication with the equalizing device, wherein the equalizing device includes a sensor for determining the relative payout of the first and second line.

13. The crane of claim 12, wherein, when the relative payout is unequal the monitoring system automatically increases or reduces the operating speed of one of the first and second winch drums.

14. The crane of claim 11, further comprising a heave compensation device coupled to the equalizing device.

15. The crane of claim 14, wherein the heave compensation device selectively induces longitudinal motion of the equalizing device in a direction substantially parallel to the incoming portions of the first and second lines.

16. The crane of claim 1, further comprising a line routing system arranged along a line path between the base of the crane and each of the first and second winch drums and the supported anchor device.

17. The crane of claim 16, wherein the line routing system includes a routing guide arranged below the base of the crane and an intermediate routing guide arranged between the routing guide and the base of the crane, wherein incoming and outgoing portions of the first and second lines extend along the routing guide and intermediate routing guide.

18. The crane of claim 17, wherein the intermediate routing guide is configured to rotate a selected fraction of the crane rotation, wherein the crane rotation is about the rotatable base.

19. The crane of claim 18, wherein the selected fraction is ½.

* * * * *